United States Patent [19]

DeSanto

[11] Patent Number: 4,519,597

[45] Date of Patent: May 28, 1985

[54] FOLDING APPARATUS WITH COMPOUND TUCKER BLADE MOTION

[75] Inventor: Ronald F. DeSanto, Palos Hills, Ill.

[73] Assignee: The Lehigh Press, Inc., Pennsauken, N.J.

[21] Appl. No.: 608,950

[22] Filed: May 10, 1984

[51] Int. Cl.[3] ..... B41L 31/08

[52] U.S. Cl. ..... 270/42; 493/28; 493/424; 270/21.1

[58] Field of Search ..... 270/8, 42, 49–50, 270/21.1; 493/356, 359–360, 28, 424–425, 427–430, 434–435

[56] References Cited

U.S. PATENT DOCUMENTS

| | | | |
|---|---|---|---|
| 650,543 | 5/1900 | North | 270/32 |
| 1,302,241 | 4/1919 | Swick | 270/72 X |
| 3,762,699 | 10/1973 | Wing | 493/434 X |
| 4,014,535 | 3/1977 | Kleid et al. | 270/21.1 X |
| 4,190,242 | 2/1980 | Bulza-Schunemann | 270/42 |
| 4,273,320 | 6/1981 | Fujishiro | 493/427 |
| 4,344,610 | 8/1982 | Jeschke et al. | 270/21.1 X |

FOREIGN PATENT DOCUMENTS

| | | | |
|---|---|---|---|
| 288590 | 11/1928 | United Kingdom | 270/19 |
| 384132 | 12/1932 | United Kingdom | 270/42 |

*Primary Examiner*—E. H. Eickholt

*Attorney, Agent, or Firm*—Trexler, Bushnell & Wolters, Ltd.

[57] ABSTRACT

A folding apparatus for separating a web into individual signatures and producing two folds in each signature, comprises an upper cylinder, a lower cylinder and an intermediate cylinder. Each of the cylinders is rotated about an axis, the axes of the upper and intermediate cylinders being parallel and spaced apart to define a given plane and the axis of the lower cylinder being parallel to the axes of the first and intermediate cylinders and offset from the plane thereof. The upper and lower cylinders rotate in the same direction and the intermediate cylinder in the opposite direction. First and second folding assemblies produce two folds in each signature. The first folding assembly includes cooperating portions carried on the upper cylinder and on the intermediate cylinder. The second folding assembly includes cooperating portions carried on the lower cylinder and on the intermediate cylinder. A cutting assembly separates the web to produce the individual signatures. Each of the folding assemblies includes a tucker blade having an axis, and a tucker blade mounting and control structure for mounting the tucker blade to one of the cylinders for compound pivotal motion comprising a motion which causes substantial alignment of the tucker blade axis with a given radius of the adjacent cylinder through a predetermined portion of cylinder rotation so as to urge the signature into a folded condition while substantially preventing wiping engagement between the tucker blade and the signature.

16 Claims, 20 Drawing Figures

FOLDING APPARATUS WITH COMPOUND TUCKER BLADE MOTION

BACKGROUND OF THE INVENTION

The invention relates to folding apparatus and more particularly to a signature or map folding apparatus for producing at least one cross-grain fold in individual signatures on a continuous web.

In the printing arts, the term "signature" refers generally to any printed sheet of material to be folded. The sheet of material may be cut from a continuously printed web of successive individual such sheets or "signatures" and thereafter folded to the desired configuration. In the case of books, the individual sheets or signatures are folded to comprise individual pages of the book which must be interfitted with other folded signatures in a given order to produce the completed book.

In the following description, the invention will be illustrated with reference to the problem of producing cross-grain folds in a previously plow-folded signature, such as a map. In this regard, a plurality of such maps may be printed, usually on both sides of a substantially continuous web of paper material.

Thereafter, the web is fed to a so-called plow folding apparatus to produce plow folds, which comprise an accordian-like series of oppositely directed folds therein. The plow-folded web must thereafter be cut into individual maps or signatures and cross-grain folded to produce individual maps or "books" as they are sometimes called. Generally speaking, two such cross-grain folds are effected in each signature, map, or book at spaced apart locations.

In accordance with a preferred embodiment of the invention, the folding apparatus also effects the separation or cutting of the printed, plow-folded web into individual signatures, maps or books. Additionally, it is also desirable to count out the books into groups of a given number for packaging, such that each group or package contains 25 books or maps, for example. In accordance with a further preferred form of the invention, this counting and sorting or delivery into such groups of a given number is also carried out in conjunction with the folding apparatus.

Producing two folds in a previously plow-folded web and simultaneously separating the web into individual signatures has been attempted in the prior art. Prior art practice has included carrying out the steps at a number of work stations, involving a number of transfers of the work, time-consuming and expensive manual procedures.

It should be recognized in this regard that the cutting and cross-grain folding of individual signatures such as a previously plow-folded map presents a difficult problem when run "on-line" at "full press speeds". By "on-line", it is meant that the foregoing process of printing, plow-folding and thereafter cutting and cross-grain folding takes place in a continuous fashion, with the web being fed through a plurality of machines or apparatus adapted to perform each operation. By "full press speed", is meant the relatively high speed operation of an automated printing press which may be on the order of several feet per second of web therethrough.

One problem noted in prior art attempts to produce such cross-grain folds on line and at full press speed is the problem of maintaining the first fold effected in the signature while producing the second fold. In this regard, it will be appreciated that both ends of the map are to be folded generally inwardly with respect to the central portion of the map or signature, and hence, a problem arises in effecting the two folds so that the folded segment or portion of the map or signature overlies the shorter folded segment thereof. One prior art apparatus attempted to proceed by producing the shorter or "rear" fold initially and thereafter feeding the map or signature to a second folding station for producing the front or longer fold. In this regard, the terms "short" and "long" with respect to the folds refer to the length of map or signature remaining from the fold itself to the distal or free (when cut) end of the signature. The terms "front" and "rear" with respect to the folds refer to the direction of travel of the map or signature as it is initially introduced into the apparatus.

However, this prior art method resulted in a relatively great length of unsupported signature protruding initially from the apparatus while the first fold was being effected. Such a length of unsupported signature tended to produce a twisting or sideways turning moment upon the signature, in turn causing the first cross-grain fold to be out of line, that is, not exactly at right angles to the longitudinal axis of signature.

A further problem in the prior art apparatus occurred in the attempt to maintain control over the once-folded signature while effecting the second fold therein. Apparatus proposed heretofore attempted transfer of the signature between individual drums or cylinders, each of which carried a folding apparatus in the form of a pair of jaws thereon for effecting a given fold. However, this attempted transfer proved difficult to carry out accurately and often resulted in undue stretching or tensioning of the map or signature as it was passed from one drum or cylinder to the next.

A related problem is that referred to as tucker blade "wipe-out". In this regard, each of the above-mentioned folding jaws cooperated with a generally flat, protruding blade member mounted to an opposing drum or cylinder and known as a "tucker blade". The function of the tucker blade is to urge the proper portion of the map or signature into the cooperating jaw to effect the fold at the proper location thereon. However, this blade inevitably frictionally contacts or "wipes" against the surface of the signature or map to either side of the center line of the intended folds, as it proceeds into and out of engagement with this center line or relative narrow portion across the map where the fold is to be effected. This is due primarily to the opposite directions of rotation of the respective cylinders upon which the tucker blade and jaws are respectively carried.

OBJECTS AND SUMMARY OF THE INVENTION

Accordingly, it is a general object of the invention to provide a novel and improved folding apparatus which avoids the foregoing problems.

A more specific object is to provide a folding apparatus in accordance with the foregoing object which is capable of producing two cross-grain folds in each signature carried on a substantially continuous web of signatures.

A further object is to provide a folding apparatus in accordance with the foregoing objects especially adapted to both separate or cut a plow-folded web into individual signatures and produce two cross-grain folds in each signature, while avoiding the foregoing problems.

A more specific object is to provide a folding apparatus according to the foregoing objects which avoids the problem of wiping of the tucker blade against the signature.

A further object is to provide a folding apparatus in accordance with the foregoing objects which is further capable of automatically counting and delivering a predetermined, desired number of folded signatures alternately to each of at least two outlets in a predetermined alternating sequence.

Briefly, and in accordance with the foregoing objects, a folding apparatus in accordance with one aspect of the invention comprises an upper cylinder, a lower cylinder and an intermediate cylinder located between the upper and lower cylinders, each said cylinder being rotatable about an axis; the axes of said upper and said intermediate cylinders being parallel and spaced apart, to define a given plane and the axis of said lower cylinder being parallel to the axes of the first intermediate cylinders and offset from said given plane. Means are provided for rotating the upper and lower cylinders in the same direction and the intermediate cylinder in the opposite direction. First and second folding means are provided for producing two folds in each signature of a continuous web of successive signatures. The first folding means comprises first tucker means carried on the upper cylinder and cooperating first jaw means carried on the intermediate cylinder. The second folding means comprises second tucker means carried on the lower cylinder and cooperating second jaw means carried on the intermediate cylinder. Means are also provided for cutting the web to produce individual signatures.

In accordance with another apsect of the invention the foregoing map folding apparatus further includes at least two outlets for receiving folded signatures and diverter means movable to at least first and second positions for directing maps to a corresponding one of the at least two outlets. Adjustable counter means is provided for counting a selectable, desired number of signatures delivered to each of the outlets and control means is coupled to the diverter means and responsive to the counter means for delivering the desired number of signatures alternately to each of the at least two outlets in a predetermined, alternating sequence.

In accordance with yet another aspect of the invention, a folding apparatus is provided including at least first and second cylinders each rotatable about an axis, said axes being generally parallel and spaced apart and means for rotating the two cylinders in opposite directions. Folding means is provided for producing at least one fold in each article to be folded. This folding means comprises tucker blade means defining an axis and tucker blade mounting and control means for mounting the tucker blade to one of the two cylinders for compound pivotal motion. This compound pivotal motion comprises a motion which causes substantial alignment of the tucker blade axis with a given radius of the other cylinder through a predetermined portion of cylinder rotation, including the portion of the cylinder rotation in which the tucker blade is in contact with the article to be folded, so as to urge the article into a folded condition while substantially preventing wiping engagement between the tucker blade and the article.

BRIEF DESCRIPTION OF THE DRAWINGS

The foregoing as well as other objects, features and advantages of the invention will be more readily appreciated upon considering the following detailed description of the illustrated embodiment, together with reference to the drawings, wherein.

DETAILED DESCRIPTION OF THE ILLUSTRATED EMBODIMENT

Figure 1:
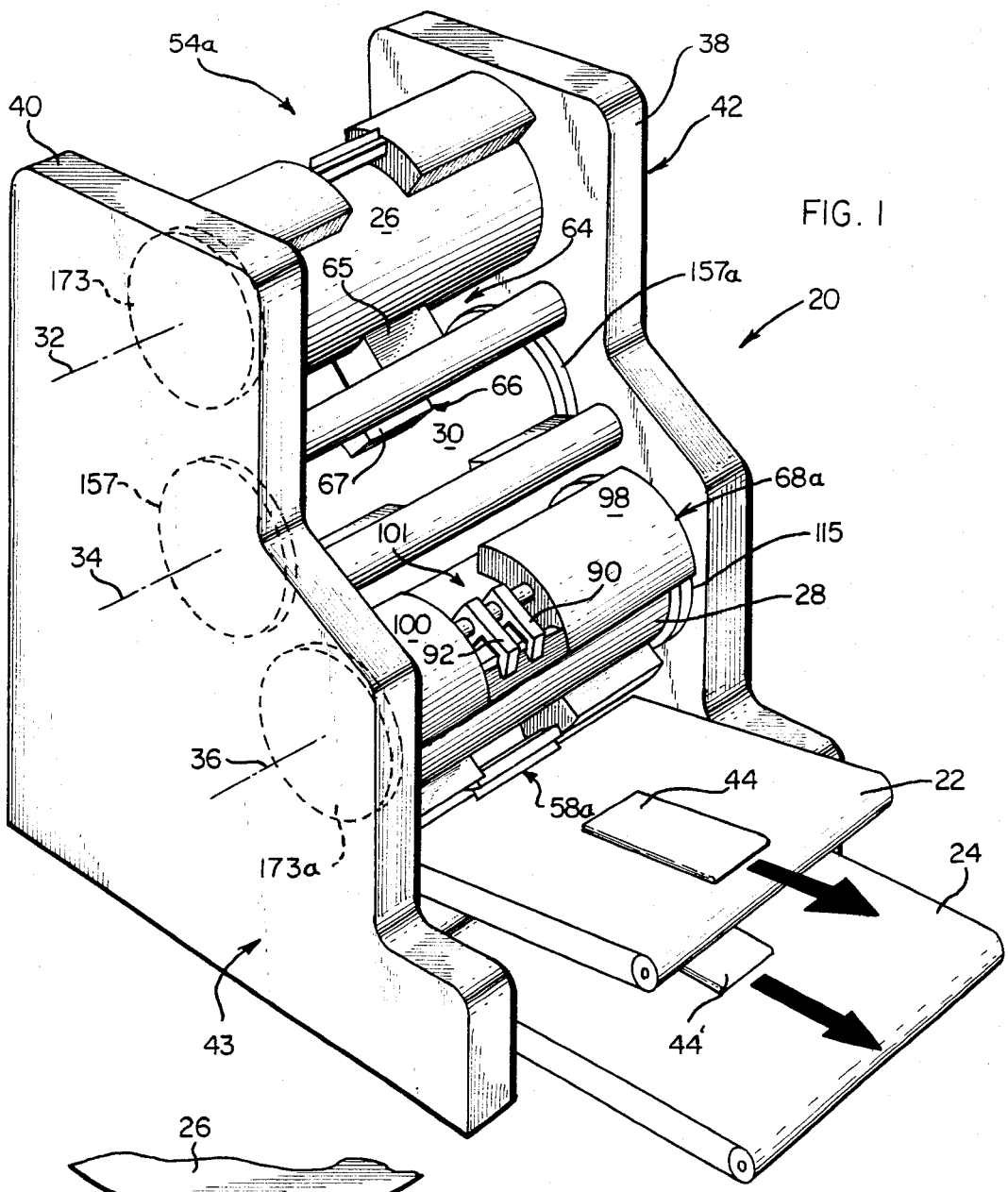
FIG. 1 is a perspective view, somewhat diagrammatic in form, of a folding apparatus in accordance with the invention.
Figure 2:
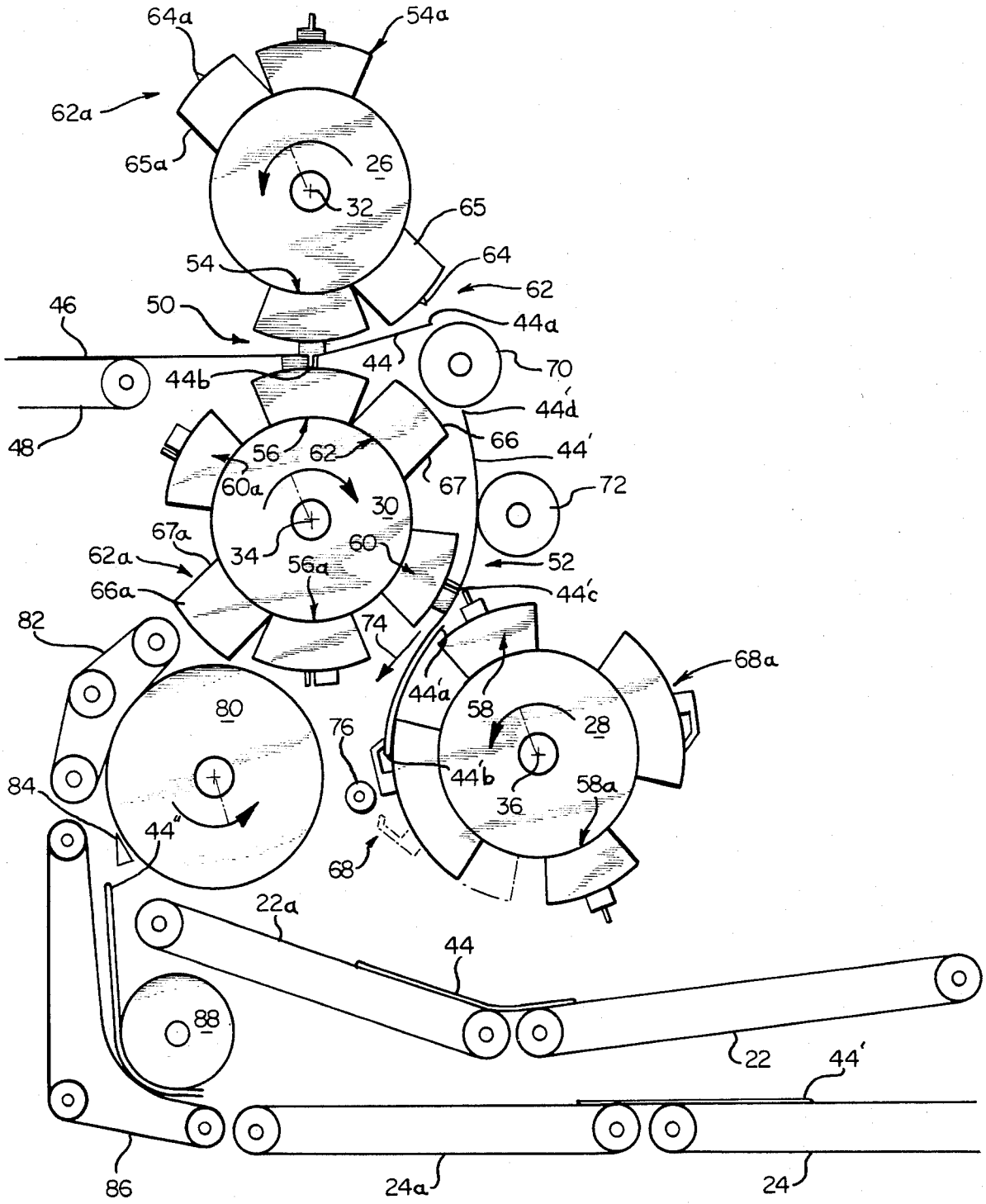
FIG. 2 is an enlarged side elevation, also diagrammatic in form, illustrating operation of the folding apparatus of FIG. 1 in accordance with the invention.

Referring now to the drawings and initially to FIGS. 1 and 2, a novel folding apparatus or machine in accordance with the invention is designated generally by the reference numeral 20. In accordance with the invention, this folding apparatus 20 is constructed and arranged for producing at least one fold in each of a plurality of foldable articles fed thereto in series. In the illustrated embodiment, the folding apparatus 20 comprises a map folding machine for producing a pair of cross-grain folds in each of a plurality of successive signatures, the signatures being fed thereto in a continuous web, and further for separating the web into individual signatures. In particular, in the illustrated embodiment the signatures comprise maps which have been printed on both sides and then plow-folded prior to introduction to the folding apparatus 20 of the invention for final, cross-grain folding. Hence, the apparatus 20 of the invention discharges at one or more outlets 22, 24, a plurality of completely folded individual maps or signatures, also referred to as "books". As will be seen later, means are provided for counting the signatures, maps or books delivered to each outlet 22, 24 for purposes of alternately delivering a predetermined number of the books to each outlet in alternating fashion. This number may be varied as desired for packaging or otherwise grouping the books into individual packages or groups of a given, preselected number.

In accordance with the invention, the folding apparatus 20 comprises an upper cylinder or drum 26, a lower cylinder or drum 28 and an intermediate or middle cylinder or drum 30. The upper cylinder 26 and intermediate cylinder 30 are rotatable about respective axes 32 and 34, indicated in phantom lines in FIG. 1. As also seen in FIG. 2, the axes 32, 34 of the upper and intermediate cylinders 26, 30 are parallel and spaced apart and hence together define a given plane. The axis 36 of the lower cylinder 28 is also parallel and spaced from the axes of the first and intermediate cylinders, but is offset somewhat from the plane defined by these first two axes 32, 34.

The cylinders 26, 28 and 30 are all supported by a pair of parallel and spaced apart walls or frame members 38, 40. The frame member 38 defines what is generally referred to as the "gear side" of the apparatus and also mounts suitable gears, driven from a motor or other suitable drive for rotating the respective cylinders 26, 28 and 30. In this regard, the additional reference numeral 42 will be understood to generally indicate the motor, gear box and/or other suitable drive means for rotating the cylinders. This drive means 42 rotates the upper and lower cylinders 26, 28 in a first or clockwise direction and intermediate cylinder 30 in the opposite or counter-clockwise direction, as viewed, and as indicated by arrows, in FIG. 2. The frame member 40 defines what is generally referred to as the "work side" of the machine 20. This frame member 40 also mounts a plurality of pulleys and interconnecting belts, to be driven from one or more of the ends of the cylinders 26, 28 and 30 supported at frame member 40. As will be seen later, these belts and pulleys, which are indicated diagrammatically by reference numeral 43, drive various guide rollers and guide belts for guiding the signatures within the machine 20, as will be seen presently with reference to FIG. 2.

As best viewed in FIG. 2, the signature or other article to be folded is designated generally by reference numeral 44. In the illustrated embodiment, this article or signature 44, as previously mentioned, comprises one signature or map of a continuous web of signatures or maps designated generally by reference numeral 46. This web 46 is fed into the folding machine at a location intermediate the upper cylinder 26 and intermediate cylinder 30 by suitable means such as an inlet conveyor or feeder belt 48.

In accordance with one aspect of the invention, first folding means designated generally 50 and second folding means designated generally 52 are provided for producing two folds in each signature or map 46 as it passes through the folding apparatus 20. In this regard, the first folding means 50 generally comprises a first tucker means or assembly 54 carried on the upper cylinder and a cooperating first jaw means or assembly 56 carried on the intermediate cylinder. Similarly, the second folding means 52 generally comprises a second tucker means or assembly 58 carried on the lower cylinder and a cooperating second jaw means or assembly 60 carried on the intermediate cylinder.

As will be more particularly described later, each of the tucker means includes a blade-like member which is adapted to urge a portion of each map or signature 46 between a pair of jaws included in the associated, cooperating jaw means, which jaws thereafter close to produce the desired fold in the signature 46. In order to accomplish cutting of the web 46 into individual signatures or maps 44, suitable cutting means are provided, and designated in FIG. 2 generally by the reference numeral 62. A first such cutting means 62 comprises a cutter blade 64 and a cooperating anvil 66.

In the illustrated embodiment, each of the cylinders 26, 28 and 30 comprises a substantially right cylindrical body having an effective circumference of substantially the same dimension as the combined lengths of two of the individual signatures or maps to be folded thereby, prior to the folding thereof. By effective circumference is meant the circumference defined by the radially outer or "working" parts (to be more fully described later) of the respective cutting means and folding means carried on each cylinder. Therefore, two signatures are accommodated for cutting and folding on each rotation of each cylinder 26, 28 and 30. In this regard, all of the cylinders are rotated at substantially the same speed, in the directions previously indicated.

Accordingly, two each of the first folding means 50, second folding means 52 and cutting means 62 are provided. In this regard, a second cutter blade **64*a* is located substantially 180 degrees apart from the first cutter blade 64 on the circumference of upper cylinder 26. Respective anvils 66 and 66*a*, which cooperate respectively with cutter blades 64 and 64*a*, are located 180 degrees apart on the circumference of intermediate cylinder 30. Similarly, a pair of similar first tucker assemblies 54 and 54*a* are located substantially 180 degrees apart on the upper cylinder while a pair of similar second tucker assemblies 58 and 58*a* are located substantially 180 degrees apart on the lower cylinder 28. In the same fashion, a pair of similar first jaw assemblies 56 and 56*a* are located substantially 180 degrees apart on the intermediate cylinder 30, while a pair of similar second jaw assemblies 60 and 60*a* are located substantially 180 degrees apart on the circumference of the second cylinder 30**.

Figure 6:
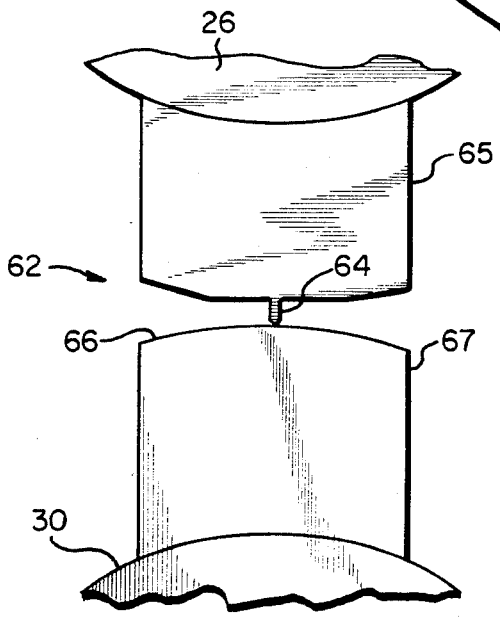
FIG. 6 is a side elevation of a knife assembly and a cooperating anvil of the apparatus of the invention.

Referring briefly to FIG. 6, it will be seen that the cutter blade 64 is mounted to a cylinder block 65 which in turn mounts to cylinder 26. Similarly the anvil or surface 66 is carried on a similar cylinder block 67 which in turn mounts to cylinder 30.

From the foregoing, it will be seen that the cutting means 62 are generally interspersed or interspaced with the folding means 50 and 52 with respect to the circumferences of cylinders 26 and 30 so as to separate the web 46 into individual signatures at desired locations relative to the two folds to be formed in each signature or map 44. That is, the respective cutter blades 64, **64*a* and anvil means 66, 66*a* may be located on respective cylinders 26 and 30 at desired angular orientations relative to the respective members 54, 54*a*; 56, 56*a* and 60, 60*a* of the first and second folding means 50, 52**. These orientations are chosen to obtain finished signatures or maps having two folds thereon at any desired locations relative to the respective free or cut, outer ends thereof.

Figure 3:
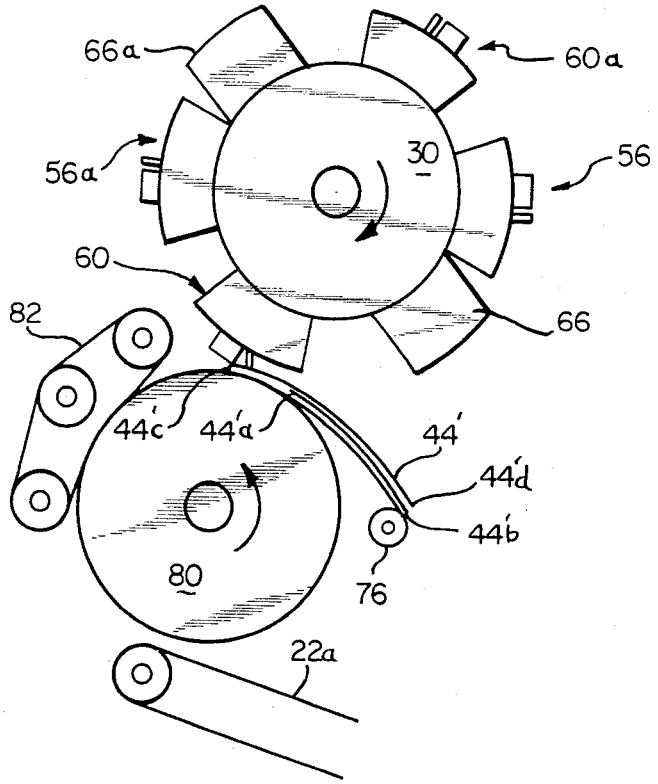
FIG. 3 is a fragmentary view of a portion of FIG. 2 showing further aspects of the operation of the apparatus of the invention.
Figure 4:
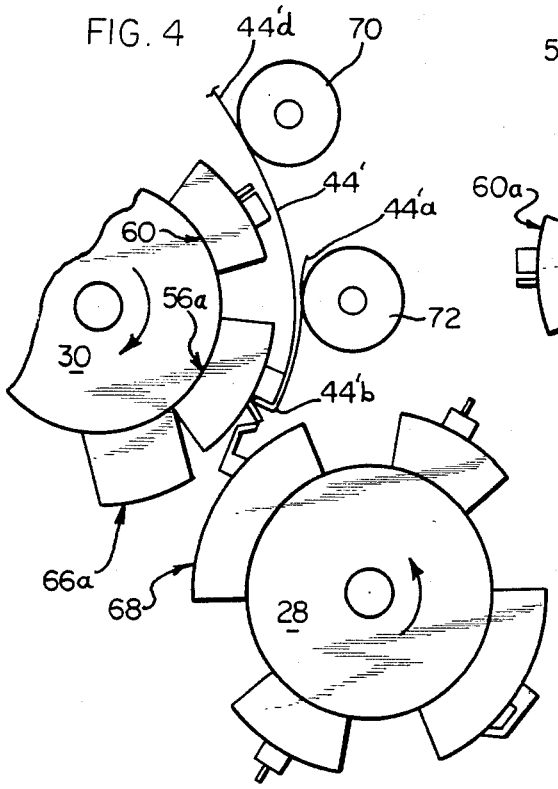
FIG. 4 is a further fragmentary view of a portion of FIG. 2, showing further aspects of the operation of the apparatus of the invention.
Figure 5:
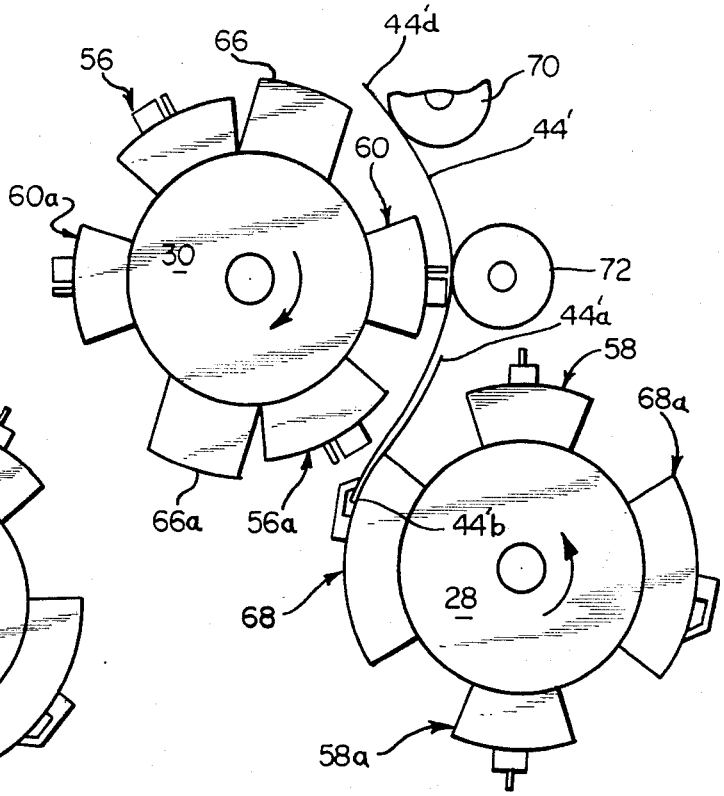
FIG. 5 is yet a further fragmentary view of a portion of FIG. 2, illustrating yet further aspects of the operation of the apparatus of the invention.

Referring now also to FIGS. 3 through 5, which illustrate further folding of a second map or signature 44', which precedes map or signature 44, the general operation of the apparatus of the invention for separating the web 46 into individual signatures 44, 44' and for producing two folds in each signature will next be described. Referring again to FIG. 2, as previously mentioned, the web 46 is initially fed into the apparatus at a location between top cylinder 26 and intermediate cylinder 30. Upon initial alignment of the proper portion of web 46 with the first cutter blade 64 and cooperating anvil 66, rotation of the cylinders 26, 28 and 30 may be commenced. Thereupon, the cutter blade 64 and anvil 66 may effect the initial cut at the desired location on the web 46 to form the leading or first outer free end 44*a* of the signature or map 44.

Thereafter, this free end 44*a* is advanced by the rotating cylinders 26, 30 whereupon the first folding means 50, comprising tucker assembly 54 and jaw assembly 56 effect a first fold in the signature 44 as indicated at 44*b*. This first fold 44*b* is a "cross-grain" fold, that is, a fold substantially perpendicular to the direction of travel of the web 46 and signature 44. The signature 44 is retained in the jaws of jaw assembly 56 as the cylinders continue to rotate. As indicated in FIG. 4, a guide roller 70 serves to guide a portion of the signature 44' from the leading edge 44'*a* to first fold 44'*b* back into surrounding relation with the cylinder 30. Upon reaching the position illustrated in FIG. 4, a first gripper means or assembly, designated generally 68, and mounted on lower cylinder 28, comes into play.

In a manner which will be more fully described later, this first gripper means or assembly 68 is held in an open condition when in the position illustrated in FIG. 4 to receive the portion about first fold 44'*b* of the signature from the assembly jaw 56 which, as will be described later, releases fold 44'*b* to be gripped by the gripper assembly 68. Immediately thereafter, as illustrated in FIG. 5, first gripper assembly 68 closes upon the first fold 44'*b*, to begin to draw the signature or map 44' about the circumference of lower cylinder or drum 28. As previously mentioned, in the preferred embodiment, the web 46 and hence the signatures 44, 44' are plow-folded prior to entering the machine 20. By plow-folding is meant a succession of oppositely directed folds which give the maps or signatures 44, 44' an accordian-like or spring-like configuration and quality. Accordingly, the cross-grain fold 44'*b* and portions of the signature or map 44' thereabout tend to rapidly move or spring radially outwardly when released by the jaw assembly 56. That is, the fold 44'*b* moves in the direction of the facing cylinder 28 to be gripped by the gripper means or assembly 68 as illustrated in FIGS. 4 and 5. In this regard, it should be noted the cross-grain fold 44'*b* is perpendicular not only to the direction of travel of the map or signature 44', but also to the direction of the plow folds previously imparted thereto.

Referring now again to FIG. 2, as previously mentioned, the third cylinder 28 has an effective circumference substantially equal to twice the length of a map or signature to be folded thereby. Accordingly, as previously explained with respect to the second tucker means comprising a pair of similar tucker assemblies 58 and 58*a*, a second similar gripping means or assembly 68*a* is also provided, spaced substantially 180 degrees apart on the circumference of the cylinder 28 from the first gripping means or assembly 68.

Referring now to the lower cylinder 28 in FIG. 2, the signature 44' is shown advanced by the gripping means or assembly 68 into position for application of a second fold by second folding means 52. Hence, tucker assembly 58 urges the desired portion of the map or signature 44' into jaw assembly 60 which thereafter closes upon the signature 44' to form a second fold 44'*c* therein. It will also be noted that at about the time of gripping of fold 44'*b* by gripper 68, the cutting means 62, comprising cutter blade means 64 and cooperating second anvil means 66, cuts or separates the signature 44' from the web 46, thus defining a trailing or second free, or outer end 44'*d* thereof. The leading edge 44*a* of map 44 is defined by this same cut. A second guide roller or idler 72 guides the map up to and including end 44'*b* about cylinder 30.

Upon formation of the second fold 44'*c* the signature 44' is carried by the jaws of the jaw assembly 60 which remain in a closed condition on the fold 44'*c*, until reaching the position generally indicated in FIG. 3. In this regard, it will also be noted that the first gripper 68 as indicated in phantom line in FIG. 2, releases the fold 44'*b* substantially immediately upon reception of the signature in the jaw means 60 of folding means 52 to form second fold 44'*c* therein. It will also be noted in this regard that the rotation of respective cylinders 28 and 30 is such that no tensioning or pulling forces are experienced by the signature 44' during the formation of second fold 44'*c*.

This is true since the jaw means or assembly 60 initially advances with a component of velocity in a direction generally indicated by the arrow 74, which is substantially the same as the velocity of the signature 44' in the direction 74 as it is pulled by the gripper means 68 at its fold 44'*b*. Thereafter, as the signature 44' is carried further in the direction 74 by the jaw assembly 60, the gripping means 68 releases fold 44'*b*. This arrangement avoids any tensioning or pulling in opposite directions upon the signature 44' during formation of second fold 44'*c* therein. It will be additionally noted that the guide cylinder 72 continues to guide the trailing end 44'*d* of the signature during formation of second fold 44'*c*.

Thereafter, and referring also to FIG. 3, a further guide roller or cylinder 76 guides the portion of signature including the first fold 44'*b* back upwardly toward intermediate cylinder 30. This motion achieves a substantially flat, fully-folded condition of the now completely folded map or "book" 44' as indicated generally in FIG. 3. In FIG. 3, a further discharge drum or roller 80 receives the now completely folded signature or map 44' from jaw means or assembly 60, which opens at this point to release fold 44'*c*, and hence the map or signature to the discharge drum 80. In this regard, an additional guide tape or belt 82 is also provided to guide the folded map or signature 44' around the circumference of discharge drum 80 which is rotated generally in the clockwise direction as indicated in FIGS. 2 and 3.

In accordance with a further feature of the invention and referring again to FIG. 2, as previously mentioned, at least two outlet means or conveyors 22, 24 are provided for receiving the completed, folded signatures, maps or "books". In this regard, diverter means diagrammatically illustrated at 84 is located for directing the completed, folded maps or signatures 44, 44' from discharge drum 80 to one of the two outlet means or conveyors 22, 24. In the illustrated embodiment, additional tapes, belts or conveyors 22*a* and 24*a* are located intermediate the drum 80 and outlet conveyors 22, 24, for feeding the maps to the outlet conveyors 22 and 24.

An adjustable counter means to be described later is provided for counting a selectable, desired number of maps or signatures delivered to each of the outlets 22, 24. A control means to be described later is coupled to the diverter 84 and responsive to the counter means for causing the diverter 84 to deliver the desired number of signatures alternately to each of the two outlets 22 and 24, by way of the corresponding outlet feeder tapes or belts 22*a*, 24*a*. In this regard, an additional guide belt or tape 86 and a facing, cooperating belt idler or drum 88, are positioned for directing maps or signatures from the outer side of diverter 84 to the lower discharge conveyors 24*a* and 24. Hence, the diverter means 84 may be alternately positioned so as to deliver or direct a desired number of signatures or books alternately to each of the two outlets 22, 24 in a predetermined, alternating sequence. Further details of the structure and operation of the diverter 84 and its control means will be described later herein with reference to FIGS. 19 and 20. The operation of the counter means for operating this control means and diverter will be described in detail later with reference to FIG. 20.

Figure 7:
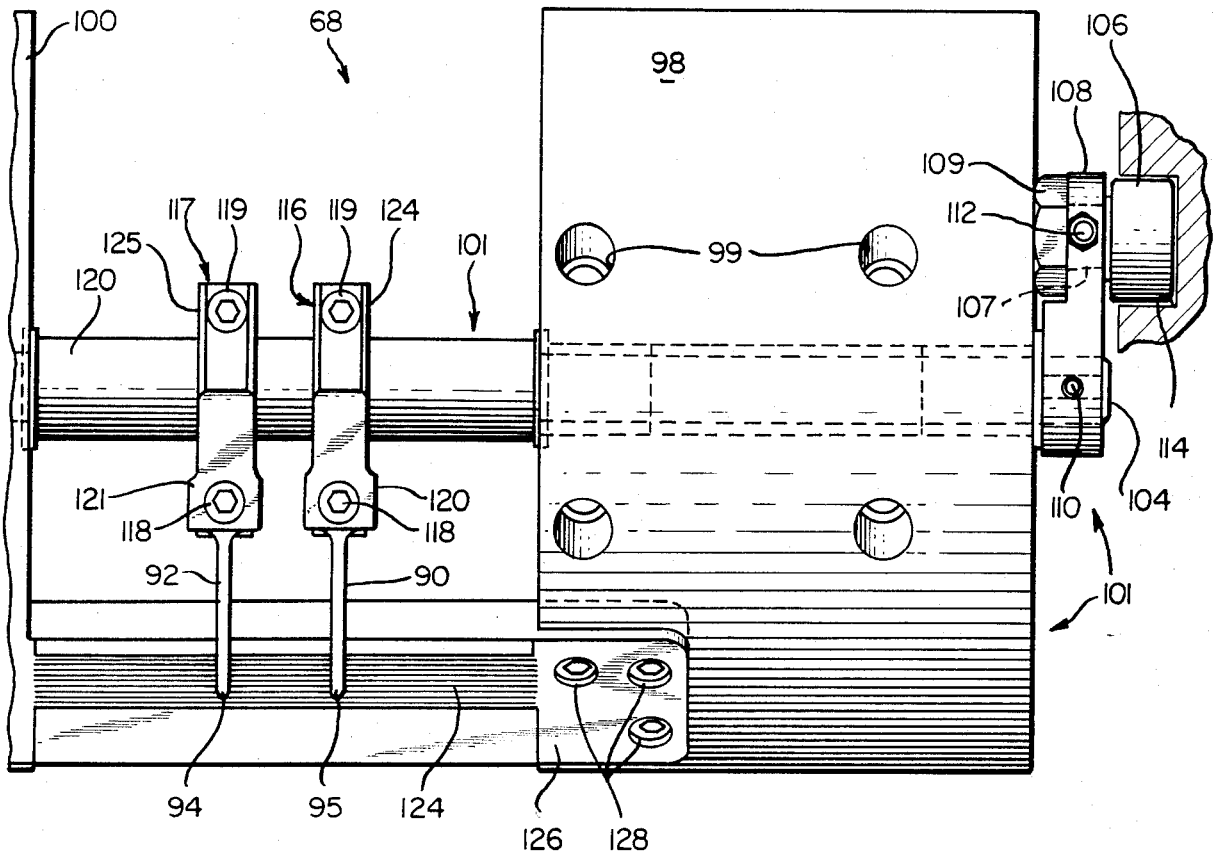
FIG. 7 is a top view, partially broken away, of a gripper assembly portion of the apparatus of the invention.
Figure 8:
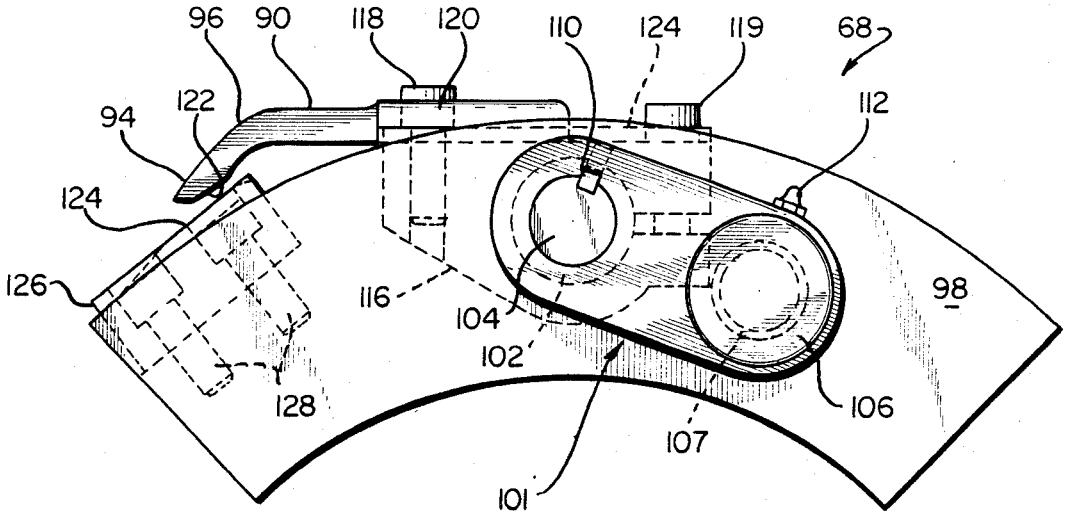
FIG. 8 is a side elevation of the assembly of FIG. 7.
Figure 9:
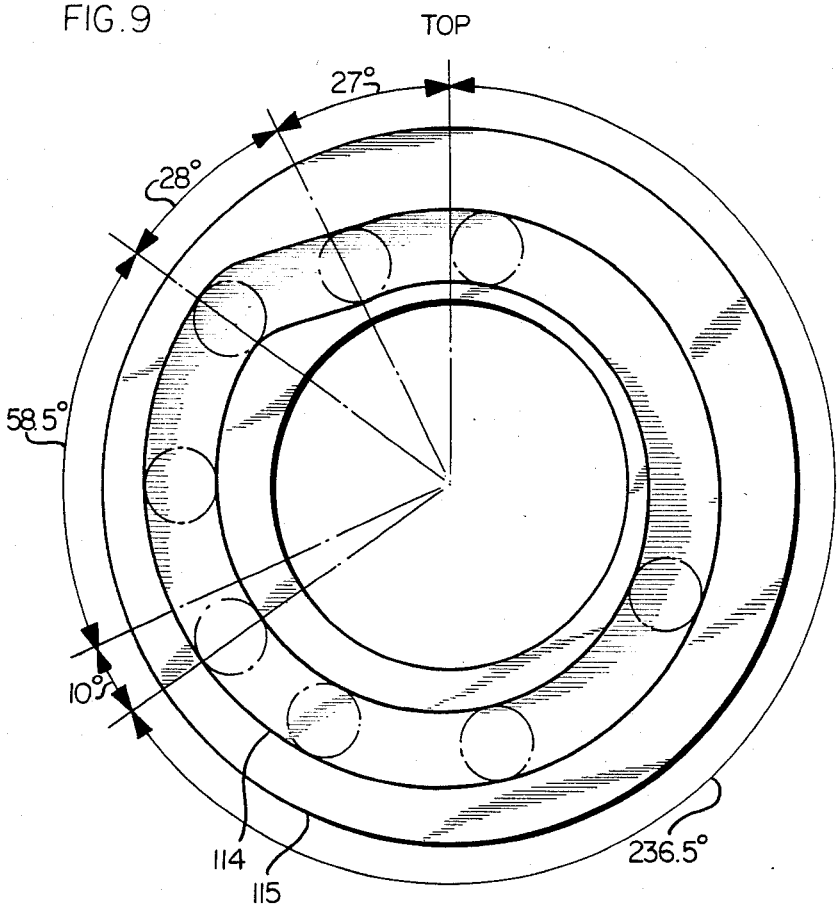
FIG. 9 is a plan view of a guide track or cam member associated with the assembly of FIGS. 7 and 8.

Referring now to FIGS. 7 through 9, the structure and operation of the gripping means or assembly 68 will next be described, it being understood that the assembly 68*a* is substantially identical. Referring initially to FIG. 7, it will be seen that the gripping assembly 68 includes gripping means in the form of a pair of gripping fingers 90, 92, which comprise relatively long, narrow members in a generally parallel and spaced apart orientation. Since these fingers 90 and 92 are substantially identical, only the finger 90 will be fully described herein. Referring also to FIG. 8 it will be seen that an outer free end or edge 94 of the finger 90 is curved downwardly or inwardly somewhat as indicated at 96, to generally follow the direction of curvature of an arcuate mounting block or cylinder block 98. A pair of substantially identical mounting or cylinder blocks 98, 100 mount the fingers 90 and 92 and an associated mounting and control means or assembly 101 therefor on the bottom cylinder 28, as seen for example in FIG. 1. Through apertures 99 in blocks 98, 100 may receive suitable fasteners (not shown) for mounting to drum 28.

The mounting and control means or assembly 101 further includes a control shaft 102 rotatably mounted in a transverse direction through the blocks 98, 100, that is, generally in parallel with the axis 36 of the drum or cylinder 28. This shaft 102 has a reduced diameter free outer end 104 which is coupled with a cam follower or roller 106 by a cam follower arm 108. The cam follower 106 includes a shaft portion 107 which is rotatably coupled to the generally straight cam follower arm 108 at a location generally spaced from the coupling of the shaft end 104 thereto. The shaft portion 107 is threaded to receive a nut 109 at the opposite side of arm 108 and is provided with a lubrication entry or grease fitting 112. A co-operating arrangement of a set screw and a key/keyway for non-rotatably coupling shaft 102 to arm 108, is indicated generally by reference numeral 110.

Figure 19:
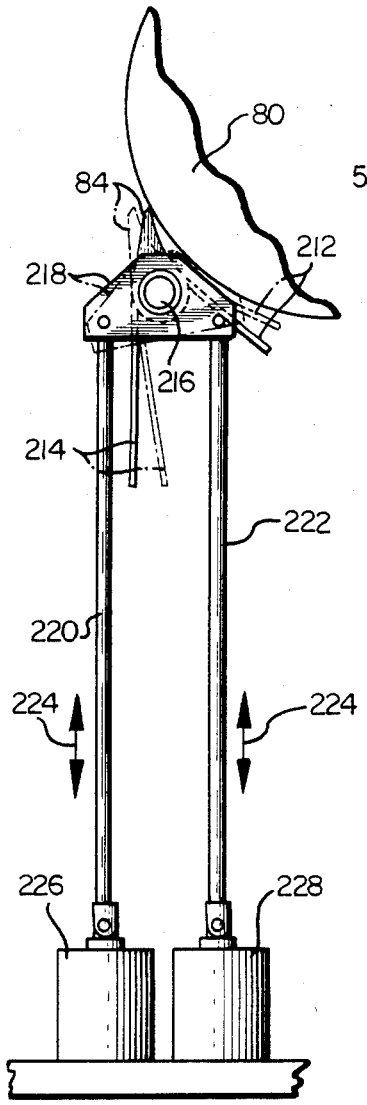
FIG. 19 is a side elevation of a diverter assembly portion of the apparatus of the invention.

The cam follower 106 comprises a generally cylindrical, roller-like member which rides in a cam track 114 formed in a circular plate 115, as illustrated in FIG. 9 (which appears adjacent FIG. 19). This plate 115 with cam track 114 is mounted in the orientation indicated by the word "TOP" in FIG. 9 to the inside of wall or frame member 38 of the apparatus, as best viewed in FIG. 1, substantially concentrically with the cylinder 28. Accordingly, as the cylinder 28 rotates, the gripper assembly 68 is carried therewith, whereby the cam follower 106 rides around the cam track 114, thereby rotating the shaft 102 bidirectionally.

It will be seen that the fingers 90, 92 are mounted to the shaft 102 by means of mounting blocks 116, 117 and pairs of fasteners 118, 119. In the illustrated embodiment, each finger 90, 92 has a trailing, generally U-shaped channel portion 120, 121 which receives therethrough one of the fasteners 118. Channels 120, 121 further engage complementary U-shaped and oppositely facing channel portions 124, 125 formed at top surfaces of blocks 116, 117, to thereby hold the fingers in a substantially parallel alignment generally perpendicular to the direction of rotation of the drum or cylinder 28. Blocks 116, 117 are held in gripping engagement about shaft 102 by the latter fasteners 119.

Referring again to FIG. 7, the leading edge of finger 94 as previously mentioned, curves downwardly, and further defines on an underside of the finger 92 a gripping edge or surface 122. This gripping surface 122 faces a complementary, stationary gripping surface 124 so as to grip the folded portion 44*b* of the signature 44 therebetween, as previously described with reference to FIGS. 2, 3 and 4. The latter surface 124 comprises a plurality of serrations formed on the face of a block 126 which is also mounted to cylinder or mounting blocks 98, 100 by suitable fasteners 128.

In operation, the rise, fall and dwell angles or arrangement of the cam track 114 as shown in FIG. 9, and the orientation thereof (as indicated by the word "TOP") with respect to the rotations of drum 28 and drum 30, are such as to open and close the gripping fingers 90 and 92, at the proper positions. That is, the gripping surface 122 is moved toward and away from the gripping surface 124, as the drum 28 rotates, for gripping and releasing the first folded portion 44*b* of signature or map 44 at the proper times and locations, as described above with reference to FIGS. 2, 3 and 4.

Figure 10:
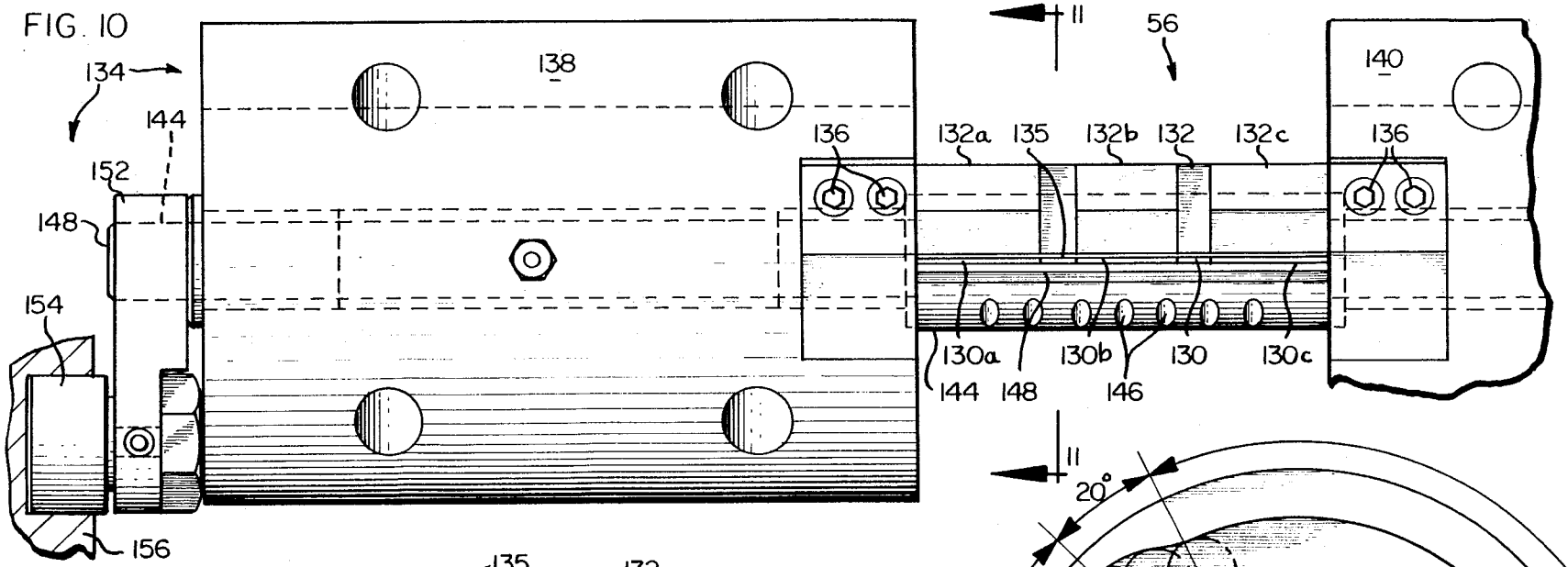
FIG. 10 is a top view of a jaw assembly portion of the apparatus of the invention.
Figure 12:
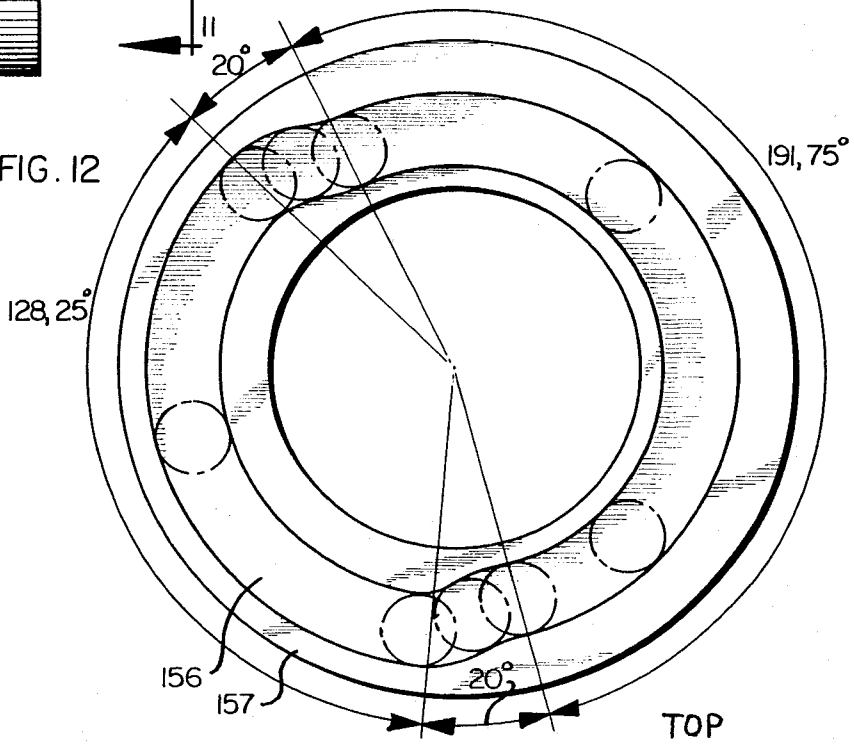
FIG. 12 is a reduced plan view of a guide track or cam associated with the assembly of FIGS. 10 and 11.
Figure 11:
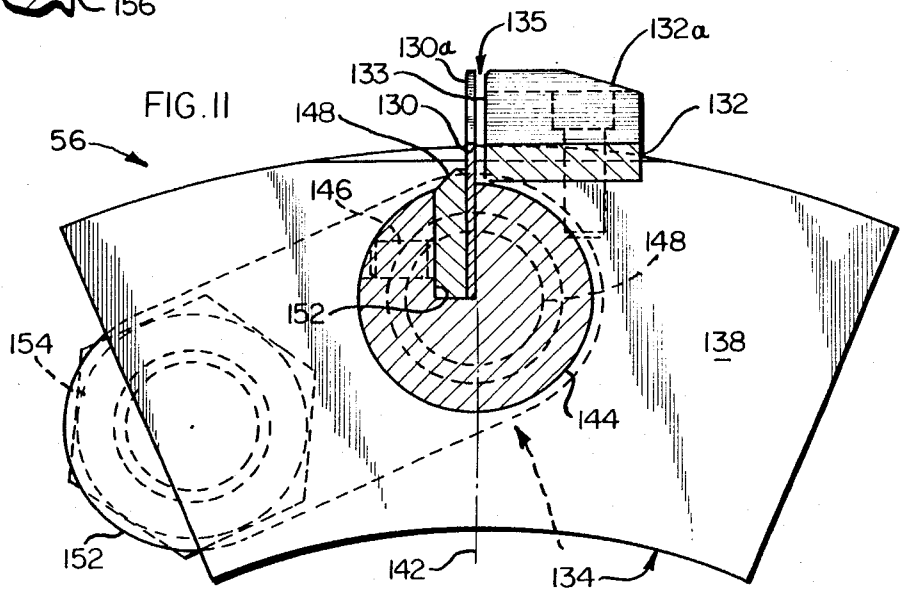
FIG. 11 is an enlarged sectional view taken generally in the plane of the line 11—11 of FIG. 10.

Referring now to FIGS. 10 through 12, the structure and operation of the jaw means or assembly portion of the folding means 50 and 52 will be next described. It will be understood that the jaw means 56, 56*a* and 60, 60*a* are substantially identical whereby only the jaw means or assembly 56 will be described. Referring initially to FIGS. 9 and 10 it will be seen that the jaw means 56 comprises a pair of jaws 130, 132, the former jaw 130 comprising a plurality of aligned relatively narrow, blade-like members 130*a*, 130*b*, 130*c* and the latter jaw member 132 comprising a like plurality of facing block-like members 132*a*, 132*b*, 132*c*. In this regard, it will be noted that the view of FIG. 10 is rotated 90 degrees from the section 10—10 indicated on FIG. 9, so as to place the jaws 130, 132 at the top of the illustration.

Jaw mounting and control means designated generally by reference numeral 134 are provided for mounting the jaws to the intermediate cylinder 30 and for alternatively opening and closing the jaws. This opening and closing is done in a predetermined fashion as the jaws rotate with the cylinder 30 so as to close the jaws about a portion of the signature to produce a fold therein, and thereafter release the signature, in the fashion described above with reference to FIGS. 2 through 5. In the embodiment illustrated in FIGS. 10 and 11, the jaws 130*a*, 130*b*, 130*c* are mounted for movement relative to facing surfaces 133 of the jaws 132*a*, 132*b*, 132*c* of the jaw member 132, which is mounted in a stationary position at outer ends thereof by fasteners 136 to cylinder blocks or mounting blocks 138, 140. These cylinder blocks or mounting blocks 138, 140 are substantially identical to the cylinder blocks or mounting blocks 98, 100 described above with reference to the mounting of the gripping means or assembly 68. These cylinder blocks 138, 140 further function identically to the cylinder blocks described above to mount the assembly 56 on the cylinder 30 at the desired location to accomplish the first and second folds in the map or signature 44 described above with reference to FIGS. 2 through 5. It will be noted that the jaws 130 and 132 define therebetween a jaw opening 135. The face 133 and opening 135 are substantially in alignment with a given radius, here diagrammatically indicated at 142, of the cylinder or drum 30.

In similar fashion to that described above for movement of the fingers of the gripping means or assembly 68, the movable jaw member 130 is mounted to a jaw control shaft 144 by a plurality of set screws 146. These set screws 146 engage a spacer or mounting block 148 which together with a portion of the blade-like jaw member 130 is held securely engaged with a complementary longitudinal slot or channel 150 which is formed in the jaw control shaft 144.

In the same fashion as described above with respect to the gripping means or assembly 68, the jaw control shaft 144 is coupled with a cam follower arm 152 which carries at its opposite end a cylindrical cam follower or roller member 154. Identical structure is utilized in this regard to that described above for the assembly of FIGS. 7 and 8, and need not be described further. This cam follower 154 is engaged in a cam track 156 formed in a circular plate 157, as illustrated in FIG. 12. As also shown in FIG. 1, and similarly to the structure and operation described for the gripping means or assembly 68, the plate 157 with cam track 156 is mounted to a side surface of the wall or frame member 40 in a substantially concentric alignment with the cylinder 30 and in the orientation indicated in FIG. 12 by the word "TOP". Accordingly, in operation, as the cylinder 30 rotates, the cam follower 154 follows the cam track 156, causing the jaw control shaft 144 to rotate bidirectionally. This rotation of jaw control shaft 144 will be seen to correspondingly move the jaw blade 130 toward and away from the stationary blade 132. This movement, together with the orientation of the cam track 156, is such as to accomplish gripping for folding and release at the desired times of the signature 44, in the fashion illustrated and described above with reference to FIGS. 1 through 5.

Figure 13:
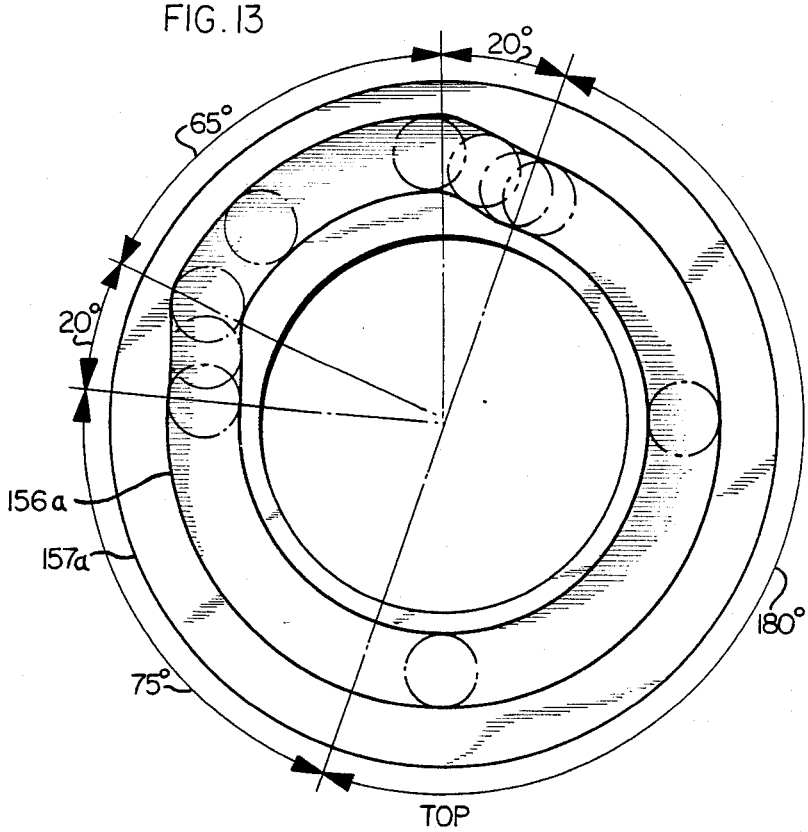
FIG. 13 is a reduced plan view of a second guide track or cam associated with a second jaw assembly.

The jaw means or assembly 56*a* is substantially identical in configuration to that just described with reference to FIGS. 10 through 12. However, it will be noted upon reference to FIG. 2 that the second jaw means 60, 60*a* are mounted in reverse orientation, that is, with the positions of the fixed jaw and movable jaw thereof (for example, jaws 132 and 130 in FIG. 11) reversed with respect to their positions in the jaw means or assemblies 56, 56*a*. Accordingly, the jaw means or assemblies 60, 60*a* are substantially identical but form a mirror image to the assemblies illustrated in FIGS. 10 and 11. Additionally, the protruding portion of the jaw control shaft, cam follower arm and cam follower of assemblies 60 and 60*a* are reversed with respect to those illustrated in FIG. 10, whereby a second, similar cam track 156*a* formed a circular plate 157*a* as shown in FIG. 13, is provided at the opposite side wall 38 for the jaw means or assemblies 60, 60*a*. Moreover, since the locations of the opening and closing of the jaws of assemblies 60, 60*a* are as illustrated in FIGS. 2 and 5, that is, when the jaws 60, 60*a* meet tucker blades 58, 58*a* of the cylinder 28, the orientation of the cam track 156*a* will be correspondingly moved from that of the cam track 156. This orientation is indicated generally by the word "TOP" in FIG. 13. Additionally, FIG. 12 shows the angular measurements in degrees of rise, fall and dwell for the cam 156, while FIG. 13 shows the same angular measurements of rise and fall and respective dwell of the cam track 156*a*. This latter cam track 156*a* is similarly mounted to wall 38, as best viewed in FIG. 1.

Referring now to FIGS. 14 through 18, in accordance with another aspect of the invention, each of the tucker means 54, 54*a* and 58, 58*a* includes a tucker blade 158 for urging the material of the map or signature 44 between the respective cooperating jaws 56, 56*a* and 60, 60*a*, to be folded. In accordance with another aspect of the invention, each of these tucker means also includes novel tucker blade mounting and control means, illustrated in FIGS. 14 through 16, and designated generally by the reference numeral 160. This structure 160 mounts and controls movement of the associated tucker blade 158 with respect to its associated one of the upper and lower cylinders 26 and 30 so as to be alignable with its associated jaw assembly, and in particular with the jaw opening, for example 135, of the associated jaw assembly during a predetermined portion of respective rotation of the cylinders. This movement of the blade, as will be more fully described hereinafter, may be referred to as a "compound pivotal" movement or motion.

Figure 14:
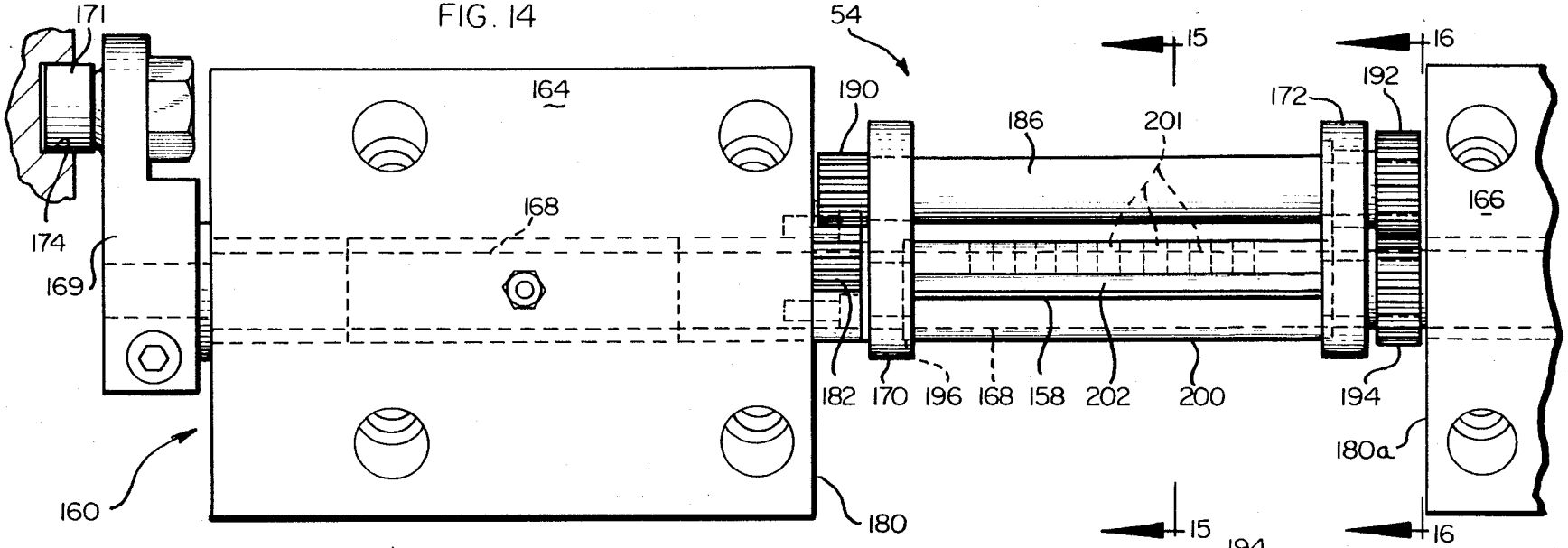
FIG. 14 is a top view of a tucker assembly in accordance with the invention.
Figure 16:
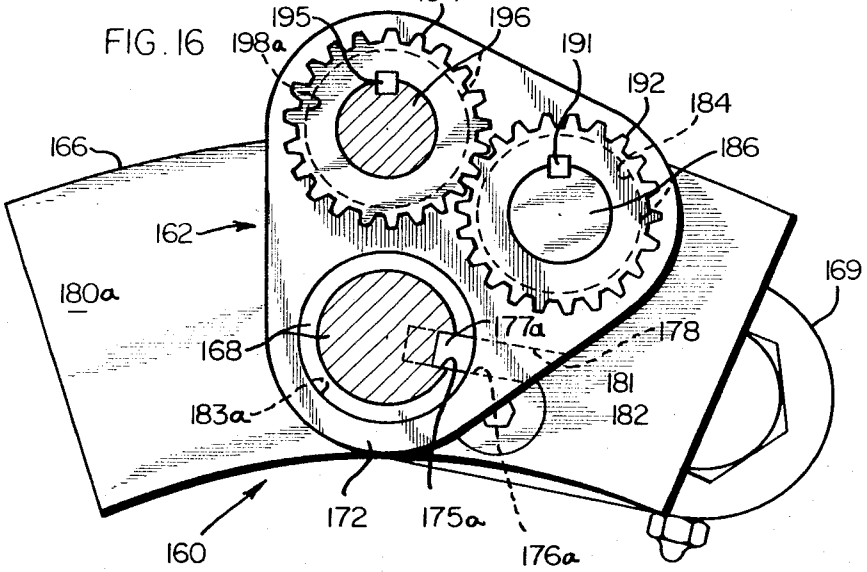
FIG. 16 is an enlarged sectional view taken generally in the plane of the line 16—16 of FIG. 14.
Figure 15:
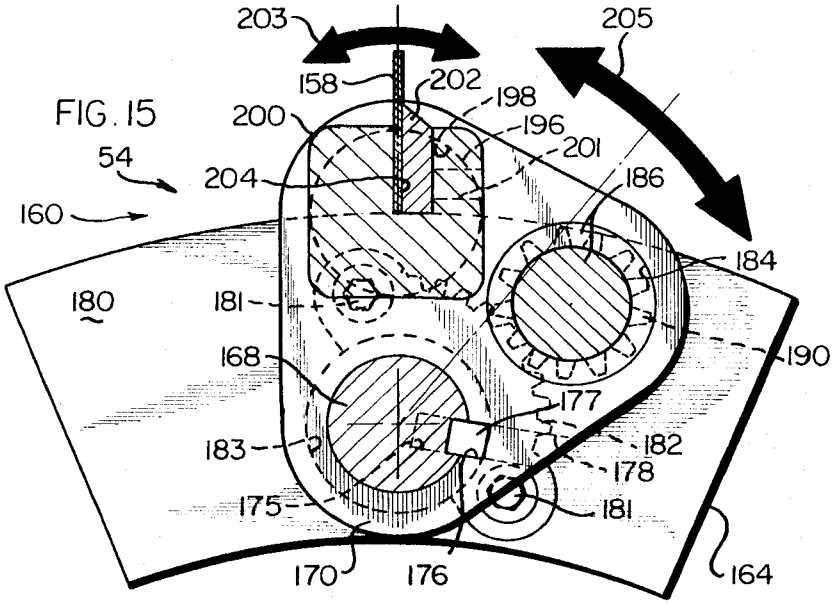
FIG. 15 is an enlarged sectional view taken generally in the plane of the line 15—15 of FIG. 14.

This tucker blade mounting and control means, as will be seen with reference to FIGS. 14 through 16, includes a rotatable means or assembly designated generally 162 for rotating the associated tucker blade 158 in a predetermined fashion. This rotation is such as to pivot and thereby maintain the blade 158 in substantially coplanar alignment with the corresponding jaw opening 135 and importantly, in colinear alignment with the associated radius, for example, 142 (see FIG. 11) throughout a predetermined arc of movement of the respective cylinders. This permits urging of the signature or map 44 into the associated jaws to be folded while substantially avoiding any wiping of the tucker blade 158 against the signature 44.

Figure 18:
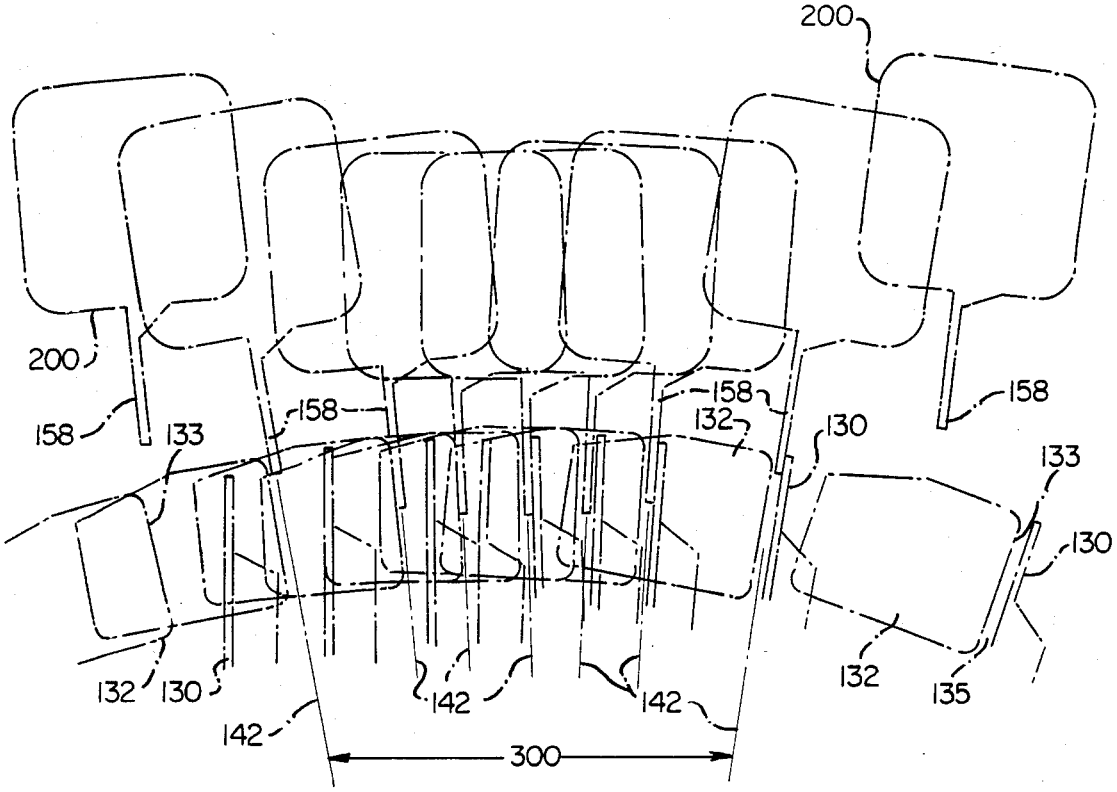
FIG. 18 is a diagrammatic view illustrating the movement of a tucker blade element achieved by the assembly and cam of FIGS. 14–17 in operation.

In this regard, and referring also briefly to FIG. 18, the desired position of the tucker blade 158 with respect to corresponding jaws 130, 132 (for example, as in FIG. 11) throughout this predetermined arc of movement or portion of cylinder rotation is generally illustrated at a plurality of points throughout this arc of movement. It will be noted that in FIG. 18 the tucker blade 158 is, through an arc 300, in substantially coplanar alignment with the radius 142 defined by the face 133 of jaw 132 and by the opening 135 between the jaws 130, 132. It will be appreciated that in this way the tucker blade may proceed directly into contact with the desired portion 44*b* of the signature or map 44 (as shown in FIG. 2) to urge this portion 44*b* between jaws 130 and 132 to be folded, without contacting the signature 44 as it approaches and recedes therefrom. Hence, this novel structure and the resultant compound pivotal motion of the tucker blade 158 substantially prevents any wiping or "wipe-out" phenomona between the blade and the article or signature 44. Such "wipe-out" phenomena was often experienced in prior attempts to achieve cross-grain folding using cooperating blades and jaws.

Referring now more particularly to FIGS. 14 through 16, only one tucker blade assembly 54 will be described herein, it being understood that the remaining tucker blade assemblies or means 54*a* and 58, 58*a* are substantially identical therewith. Initially, it is noted that the mounting and control means 160 and rotatable means 162 thereof are respectively mounted to the cylinder 26 by means of a pair of cylinder blocks or mounting blocks 164, 166, substantially in the same fashion as described above with respect to the gripper assemblies and jaw assemblies.

These blocks 164, 166 rotatably receive therethrough a main tucker blade control shaft 168, which is coupled at an outer end thereof to one side of a cam follower arm 169 whose opposite side mounts a generally cylindrical and rotatable cam follower 171 which rides in a cam track 174. The coupling structure and arrangement of the shaft 168 cam follower arm 169 and cam follower 171 is substantially identical to that described above with respect to the gripper assembly and jaw assembly. The tucker cam track 174, formed on a circular plate 173, is shown in FIG. 17, wherein the respective rise, fall and dwell angles are also indicated.

Figure 17:
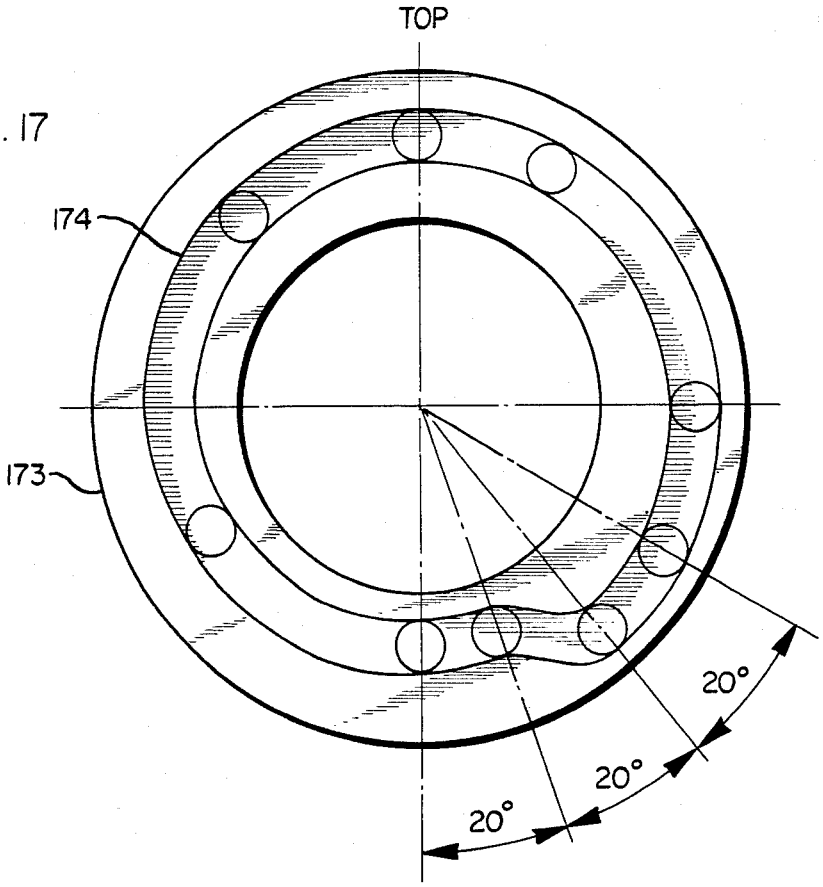
FIG. 17 is a plan view of a guide track or cam associated with the assembly of FIGS. 14–16.

Additionally, referring also to FIG. 1, the orientation of the tucker cam 174 is as indicated by the word "TOP" in FIG. 17, and plate 173 is affixed to side wall or frame member 40, generally in concentric arrangement with respect to upper cylinder 26. A substantially identical such tucker cam 174*a* is formed on a plate 173*a* mounted to the wall or frame member 40 generally opposite the cam 114 on plate 115 and concentric with the lower cylinder 26. The orientation of the cam 174*a* is so as to achieve blade motion as just described with respect to its tucker blade assemblies 58, 58*a* and the cooperating jaw assemblies 60, 60*a* during the portion of cylinder rotation where folding is desired, as explained above with reference to FIGS. 2–5.

Referring now again to FIGS. 14 through 16, the tucker control shaft 168 is non-rotatably coupled to a pair of swing brackets 170, 172 which are illustrated respectively in FIGS. 15 and 16. This non-rotatable coupling is achieved by aligning a pair of similar key seats 175, 175*a* in the shaft 168 with complementary keyways 176, 176*a* in the respective swing brackets to receive keys 177, 177*a*. The respective keyways 176 and 176*a* are further aligned with tapped through apertures 178, 178*a* in the respective swing brackets which receive suitable set screws (not shown) therein to further hold the keys and hence hold swing brackets 170, 172 for rotation in unison with the tucker blade control shaft 168.

Mounted by fasteners 181 to an inwardly facing side wall or surface 180 of the cylinder block 164 is an arcuate gear rack 182. This arcuate gear rack 182 is arranged in generally surrounding but non-interfering relation to the tucker blade control shaft 168. The swing brackets 170, and 172 will be seen to be generally triangularly shaped, with the shaft 168 passing through suitably aligned through openings 183, 183*a* adjacent and in alignment with one apex of each of the triangular swing brackets 170, 172. Generally in alignment with second apices thereof, a second pair of through openings 184, 184*a* in the swing brackets rotatably mount a second shaft 186.

Mounted to rotate in unison with this shaft 186 and intermediate the surface 180 of cylinder block 164 and a facing surface of swing bracket 170 is a gear 190 arranged to ride upon the rack 182 as the swing brackets 170 and 172 rotate in unison with the shaft 168. At the opposite end of this shaft 186 is mounted, as by cooperating key/keyways 191, a second gear 192, which is located generally intermediate an inwardly facing surface 180*a* of the cylinder block 166 and the facing surface of swing bracket 172. This second gear 192 intermeshes with a substantially identical third gear 194 which is mounted, as by a similar key/keyway arrangement 195 to a further shaft 196. This latter shaft 196 is generally rotatably carried within aligned through apertures 198, 198*a* provided therefore in the respective swing shafts 170 and 172 and in alignment with the third apices thereof.

A portion of shaft 196 intermediate the inwardly facing surfaces of swing brackets 170 and 172 is formed as a generally rectilinear tucker blade mounting block 200. The mounting of the tucker blade 158 is accomplished in substantially the same fashion as described above with respect to the mounting of the gripper blade member 130. In this regard, a blade holder bar 202 and the blade 158 are securely engaged by suitable means such as a plurality of set screws 201 within a complementary elongate and aligned channel or slot 204 formed therefor in the blade holder block 200 portion of shaft 196. Hence, the blade 158 rotates in unison with the shaft 196, as indicated by arrows 203.

In operation, the tucker blade control shaft 168 rotates bidirectionally in response to travel of the cam follower 171 in the cam track 174. Responsive to this rotation, the swing brackets 170, 172 swing back and forth as indicated by arrows 205, drawing the first gear 190 and shaft 186 to which it is coupled bidirectionally upon the gear rack 182. This simultaneously rotates gear 192 which is mounted at the opposite end of the same shaft 186, for rotation in unison with gear 190. Thereupon, it will be appreciated that reverse rotation is imparted to gear 194 which is engaged with gear 192. Hence, reverse rotation with respect to the direction of rotation of shaft 168 and swing brackets 170, 172 is generally imparted to tucker blade 158. This occurs because tucker blade 158 is coupled to rotate in unison with the same shaft 196 which is coupled to and hence rotated by gear 194.

Accordingly, the compound motion of the tucker blade will be seen to be effected by the combination of the bidirectional rotation of the shaft 168 and corresponding rocking of swing brackets 170 and 172, and the opposite rotation imparted thereto by the interaction of the gear assembly comprising gear rack 182 and gears 190, 192 and 194 as just described. The foregoing motion is herein referred to as a "compound pivotal motion" and is achieved in response to rotation of the associated cylinder, either top cylinder 26 or lower cylinder 28, and the attendant movement of the cam follower 171 within its associated cam track 174 or 174*a*. Hence, this interaction of the foregoing parts is such as to achieve the sequence of blade positions illustrated in FIG. 18 as the blade approaches, engages and recedes from the signature 44 to substantially avoid wiping engagement therebetween, as discussed above.

Hence, the tucker blade mounting and control means 160 generally comprises the stationary cam surface or cam track 174 mounted adjacent an axial end of the associated cylinder 26 or 28 and shaft means 168 rotatably mounted with respect to the cylinder and operatively coupled with the tucker blade. The mounting and control means further includes the cam follower means 171 mounted to follow the cam track 174 and operatively coupled for bidirectionally rotating the shaft 168 in response to movement along the cam surface. Further included in the control means are the gear means including the swing shafts 170, 172, gear rack 182 and gears 190, 192 and 194. These gear means are coupled intermediate the shaft means 168 and tucker blade 158 for causing the above-described compound pivotal motion of the tucker blade means in response to the bidirectional rotation of the shaft means 168.

Referring next to FIG. 19, details of the diverter means or structure previously briefly described with reference to FIG. 2 are illustrated. As previously indicated, the diverter 84 comprises a generally triangularly configured blade or V-shaped member which has an apex 210 and a pair of divergent leg portions 212, 214. The leg 212 is generally curvilinear in configuration, generally following the outer contour of the discharge drum 80, while the second divergent leg 214 defines a generally flat or planar surface. It will be understood that the depth of the diverter 84, that is, looking into the view of FIG. 18 is at least as great as the width of the article, signature or map 44 to be diverted thereby. Hence, the diverter 84 is located generally in the same position relative to the axial lengths of respective drums 26, 28 and 30 as the respective cutting, folding and gripping assemblies thereon is indicated generally in FIG. 1. In this regard, the relative width or extent along the axial dimension of the drums of each of these assemblies is preferably somewhat greater than the width of the map or signature to be handled in the apparatus 20 of the invention.

The diverter blade or member 84 is mounted to a transverse shaft 216 which is in turn non-rotatably supported in a bracket 218, it being understood that a suitable bearing (not shown) is provided to rotatably receive an opposite axial end of the shaft 216. The bracket 218 is in turn supported at either side thereof by rods or shafts 220 and 222. Each of these rods or shafts in turn is coupled for movement in a generally upward and downward direction as indicated by arrows 224 to a corresponding piston-and-cylinder assembly, these assemblies being generally designated by respective reference numerals 226 and 228.

It will be appreciated from the foregoing that the shafts 220 and 222 may be moved in unison in generally opposite directions to achieve rotation in one direction or the other of the bracket 218 and shaft 216 and attendant movement in a corresponding direction of the diverter member 84. With the diverter member moved generally to the position shown in solid line in FIG. 19, maps or signatures are diverted from the discharge drum 80 generally to the lower outlet belt 24 as previously indicated with reference to FIG. 2. On the other hand, with the rods 220 and 222 oppositely actuated so as to rotate the shaft 216 in the counter-clockwise direction as viewed in FIG. 19, the diverter 84 is moved to the position illustrated in phantom line. In this position, the signatures or maps or "books" (as they are referred to when completely folded), are now diverted around the underside of discharge drum 80 to the upper outlet tape or belt 22.

Figure 20:
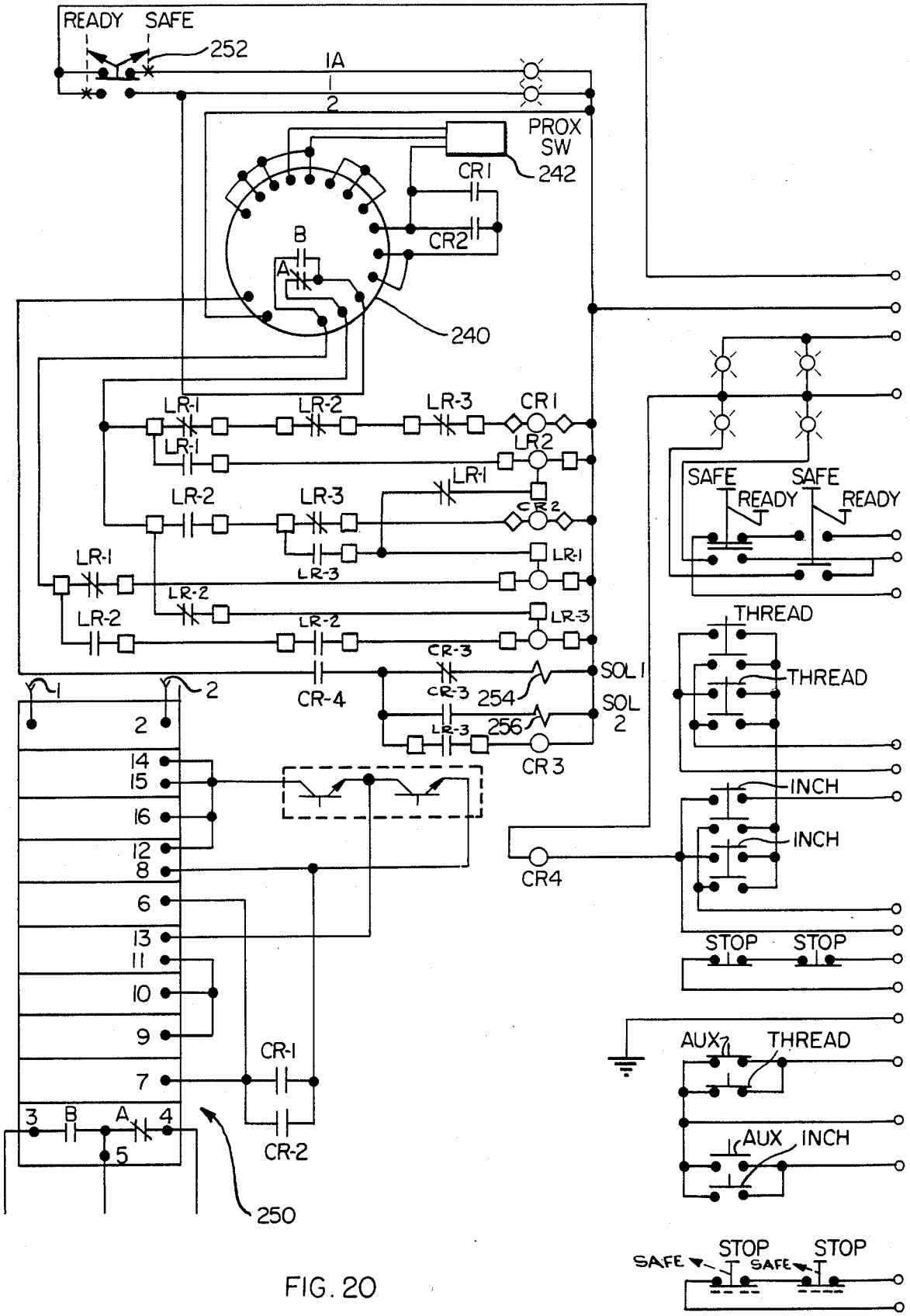
FIG. 20 is a circuit diagram of a control circuit for controlling the operation of the diverter assembly of FIG. 19.

The respective pistons 226 and 228 are actuated by an electrical control assembly and circuit illustrated in FIG. 20 to which reference is now invited.

As previously indicated, suitable counter means comprising a counter 240 is provided for counting the maps or books delivered to each discharge belt 22, 24. In this regard, suitable sensor means such as a proximity switch sensor 242 may be placed in a suitable position (not illustrated) to produce two counts for each rotation of the cylinders 26, 28 and 30 and hence one count or pulse for each signature or map delivered to one or the other of the outlets 22, 24. It will be remembered in this regard that the effective working circumference of each of the cylinders is substantially twice the length of the maps or signatures to be folded, whereby each rotation thereof accomplishes folding of two such signatures. It will be appreciated that other arrangements or numbers of signatures per rotation of the cylinders may be affected without departing from the invention.

This counter means 240 is coupled to control the pistons 226 and 228 by way of suitable control circuitry designated generally by reference numeral 244. In the illustrated embodiment the counter 240 is wired for counting 25 maps or signatures before actuating the circuitry for reversing the location of the diverter 84. However, it will be understood that the counter is readily adjustable, for example by changing the external wiring thereof, for counting fewer or greater numbers of maps or signatures as desired. Accordingly, control circuit 244, pistons 226 and 228 and rods 220 and 222, as well as bracket 218 and shaft 216 may be regarded as control means coupled to the diverter means 84 and responsive to the counter means 240 for delivering the desired number of signatures alternately to each of the two outlets in a predetermined, alternating sequence, as previously generally described with reference to FIG. 2.

Referring now more particularly to FIG. 20, the circuit is indicated by generally conventional symbols for various components such as relay coils, normally open and normally closed sets of relay contacts and respective terminals thereof, as well as various push-type switches and the like. A suitable power supply for the circuit includes mode selection, clock inverter, DC supply and output, clock generator, clock, bounce suppressor, start and relay output sections, as indicated generally at reference numeral 250. Additional start-up circuitry is provided for driving a suitable electric motor (not shown) comprising the motive power means of gear box 42, previously mentioned with reference to FIG. 1.

A plurality of control switches generally on the right-hand side of the circuit permit initial threading and alignment or "inch" control in both main and auxilliary switching sets for permitting initial threading of the web 46 into the apparatus of the invention, as indicated generally in FIG. 2. Hence, initial rotation for alignment and start-up purposes is permitted without initially activating the counter for control of the outlet diverter means 84.

The sequence of operation of the circuit of FIG. 20 will next be generally described. The switch 252 is initially actuated to the "ready" position, whereupon 120 volt power is fed to the normally open contacts CR-4, which are located at about the middle of line 13 of the diagram. In this regard, the respective normally open and normally closed contacts will here be designated with hyphenated reference characters corresponding to the relays of which they are a part. The corresponding relay coils are designated by like, non-hyphenated characters.

If the apparatus is in the "THREAD" mode, that is, with the THREAD switch energized, relay coil CR4 will be energized by way of the INCH circuit of the apparatus (not shown). This will cause the closing of the normally open contact CR-4 (line 13) providing power to the contacts CR-3 in lines 13 and 14 and the contacts LR-3 in line 15. It will be noted that solenoids 254 and 256 responsible for energizing respective pistons 226 and 228 of FIG. 18 are also located in lines 13 and 14, and are further designated as solenoid No. 1 (SOL#1) and solenoid No. 2 (SOL#2), respectively.

Closing of switch 252 also feeds 120 volt power to the counter 240 which responds by resetting to zero. At the same time contact A of the counter remains in its normally closed state and contact B of the counter remains in its normally open state. Accordingly, relay coil CR1 in line 5 is energized through the normally closed contacts A of the counter by way of normally closed contacts LR-1, LR-2 and LR-3. This closes contacts CR-1 in line 1. The unlatched coil of relay LR3 (line 12) is also energized through normally closed contact LR-2 in line 11, providing power to solenoid No. 1 (254) by way of the normally closed contacts CR-3 of line 13.

The counter now begins its first count cycle and opens normally closed contact A. This causes relay coil CR1 in line 5 to de-energize, whereby contact CR-1 in line 1 opens. At the same time, contact B of the counter 240 closes causing the latch coil of relay LR1 to be energized through normally closed contact LR-1 of line 10. All of the LR-1 contacts (in lines 5, 6, 7, 10 and 12) are then latched to their energized positions, that is, the positions opposite to their de-energized positions which are illustrated in FIG. 20. By way of example, normally closed contacts LR-1 in line 5, will now go to an open condition, while normally open LR-1 contacts of line 6 now close.

At the end of the predetermined count cycle, which in the illustrated embodiment comprises 25 counts, the counter resets, opens contact B and closes contact A thereof. Accordingly, the latch coil of relay LR2 in line 6 is energized through the previously latched normally-open contacts LR-1 in line 6. Accordingly, all of the LR-2 contacts (lines 5, 8, 11 and 12) are now latched to the energized position, that is, the position opposite that shown in the circuit diagram. Relay coil CR2 in line 8 is therefore now energized, closing normally open contacts CR-2 in line 2.

The counter now begins a second count cycle, opening contacts A and closing contacts B. The latch coil of relay LR3 in line 12 is now energized by way of contacts LR-1 and LR-2 in line 12. Accordingly, all of the LR-3 contacts (in lines 5, 8, 9 and 15) are now latched to the energized position, in the same fashion described above with respect to relays LR-1 and LR-2. Relay coil CR3 therefore is now energized through contacts CR-4 in line 13 and contacts LR-3 adjacent thereto in line 15. Accordingly, solenoid No. 1 (254) is now de-energized and solenoid No. 2 (256) is now energized through the contacts CR-4 in line 13 and CR-3 in line 14.

At the end of the next count cycle (corresponding to the passage of 25 maps to one or the other of the outlets 22, 24) the counter 240 again resets, opens contacts B and closes contacts A. Accordingly, the unlatch coil of relay LRl is now energized through contacts LR-2 of line 8 and LR-3 of line 9. The LR-1 contacts now will return to their de-energized state, that is, the normally open or normally closed condition as illustrated in FIG. 20. The unlatch coil of relay LR2 is now energized through contacts LR-1 in line 7, LR-3 in line 9, and LR-2 in line 8. This causes the LR-2 contacts all to return to their de-energized state, that is, the normally open or normally closed states illustrated in FIG. 20. Accordingly, the unlatch coil of relay LR3 is now energized by way of the contact LR-2 of line 11. This returns the system to the condition it was in when the power was initially turned on to the counter 240, whereby the counter may again reset and begin to count, alternately energizing solenoids 254 and 256 to divert maps alternately to outlet 22 or outlet 24 during each count cycle.

While the invention has been illustrated and described herein with reference to a preferred embodiment, the invention is not limited thereto. It will be obvious to those skilled in the art that changes and modifications of the present invention, in its various aspects, may be made without departing from the invention in its broader aspects. Some of these changes and modifications may be matters of routine engineering or design and others may be apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A folding apparatus for separating a web into individual signatures and producing two folds in each signature, comprising: an upper cylinder, a lower cylinder and an intermediate cylinder located between the upper and lower cylinders, each said cylinder being rotatable about an axis; the axes of said upper and said intermediate cylinders being parallel and spaced apart to define a given plane and the axis of said lower cylinder being parallel to the axes of the first and intermediate cylinders and offset from said given plane; means for rotating said upper and lower cylinders in the same direction and said intermediate cylinder in the opposite direction; first and second folding means for producing said two folds in each said signature; said first folding means comprising first tucker means carried on said upper cylinder and cooperating first jaw means carried on said intermediate cylinder; said second folding means comprising second tucker means carried on said lower cylinder and cooperating second jaw means carried on said intermediate cylinder; and means for cutting the web to produce the individual signatures.

2. A folding apparatus according to claim 1 wherein each said jaw means comprises a pair of jaws; jaw mounting and control means for mounting said jaws to said intermediate cylinder and for alternatively opening and closing said jaws in a predetermined fashion as said jaws rotate with said cylinder for closing about a portion of a signature to produce a fold therein; a jaw opening between said jaws and generally defining a predetermined radius of said intermediate cylinder; and wherein each said tucker means comprises a tucker blade and tucker blade mounting and control means for mounting said tucker blade to one of said upper and lower cylinders so as to be alignable with the predetermined radius defined by an associated jaw opening during a predetermined portion of the respective rotation of said cylinders; said tucker blade mounting and control means comprising rotatable means for rotating said tucker blade in a predetermined fashion so that said tucker blade remains in substantially coplanar alignment with said predetermined radius of said intermediate cylinder aligned therewith throughout a predetermined arc of movement of the respective cylinders for urging said signature into said jaws for folding thereby while substantially avoiding wiping of said tucker blade against said signature.

3. A folding apparatus according to claim 1 and further including at least two outlet means for receiving folded signatures; diverter means movable to at least first and second positions for directing said folded signatures to a corresponding one of said at least two outlet means; adjustable counter means for counting a selectable, desired number of signatures delivered to each of said outlet means; and control means coupled to said diverter means and responsive to said counter means for delivering said desired number of signatures alternately to each of said at least two outlets in a predetermined, alternating sequence.

4. A folding apparatus according to claim 1 wherein each of said jaw means comprises a pair of closable jaws carried on said intermediate cylinder for gripping a portion of said signature to effect a fold therein, one of said jaws having a surface generally in alignment with a predetermined radius of said intermediate cylinder; and wherein each of said tucker means comprises a tucker blade protruding from one of said upper and lower cylinders and rotatable therewith to meet the cooperating pair of jaws as the respective cylinders rotate for urging a portion of said signature into said cooperating jaws to be folded thereby; said tucker blade defining an axis; and tucker blade mounting and control means for mounting said tucker blade to said one cylinder for compound pivotal motion; said compound pivotal motion comprising a motion which causes substantial alignment of said tucker blade axis with said predetermined radius through a predetermined portion of cylinder rotation in which said tucker blade approaches, contacts and recedes from said signature, so as to urge said signature into said jaws while substantially preventing wiping engagement between said tucker blade and said signature.

5. A folding apparatus according to claim 1 wherein each of said upper, lower and intermediate cylinders comprises a right cylindrical body; and wherein the first and second folding means and cutting means are carried on the circumference of the respective cylinders to define an effective circumference of substantially the same dimension as the length of two of said signatures, prior to folding thereby.

6. A folding apparatus according to claim 1 in which said cutting means is interspersed with said folding means.

7. A folding apparatus according to claim 6 wherein said cutting means comprises a pair of cutter blade means mounted substantially 180 degrees apart on the circumference of said upper cylinder; and a pair of anvil means located substantially 180 degrees apart on the circumference of said intermediate cylinder; said cutter blade means and said anvil means being respectively oriented for meeting during rotation of said upper and intermediate cylinders to effect the separating of said web into individual signatures.

8. A folding apparatus according to claim 1 wherein said means for rotating said upper, lower and intermediate cylinders rotates all of said cylinders at substantially the same speed.

9. A folding apparatus according to claim 5 wherein each of said first and second tucker means comprises a pair of similar tucker assemblies located substantially 180 degrees apart on each of the upper and lower cylinders and wherein each of said first and second jaw means comprise two similar jaw assemblies located substantially 180 degrees apart on said intermediate cylinder.

10. A folding apparatus according to claim 9 wherein said cutting means is interspersed with said folding means for separating said web into said individual signatures at a desired location thereon relative to said two folds to be formed in each signature.

11. A folding apparatus for producing at least one fold in each of a substantially continuous flow of foldable articles comprising: a first cylinder and a second cylinder, each said cylinder being rotatable about an axis; said axes being generally parallel; means for rotating said first cylinder in a first direction and said second cylinder in the opposite direction; folding means for producing said fold in each said article; said folding means comprising tucker means carried on one of said first and second cylinders and cooperating jaw means carried on the other of said first and second cylinders; wherein each of said jaw means has a jaw opening generally defining a predetermined radius of the cylinder on which said jaw means is mounted; and wherein said tucker means comprises a tucker blade protruding from the cylinder on which said tucker means is mounted and rotatable therewith to meet said jaw means as the respective cylinders rotate for urging a portion of said article into said jaw opening to be folded therein; said tucker blade having a tucker blade axis; and tucker blade mounting and control means for mounting said tucker blade for compound pivotal motion; said compound pivotal motion comprising a motion which causes substantial alignment of said tucker blade axis with said predetermined radius through a predetermined portion of cylinder rotation in which said tucker blade approaches, contacts and recedes from said article so as to urge said article into said jaws while substantially preventing wiping engagement between said tucker blade and said article.

12. A folding apparatus for producing at least one fold in each of a plurality of foldable articles fed thereto in series, comprising: a first cylinder and a second cylinder, each said cylinder being rotatable about an axis; said axes being generally parallel and spaced apart; means for rotating said first cylinder in a first direction and said second cylinder in the opposite direction; and folding means for producing said fold in each said article; said folding means including a tucker blade having an axis, and tucker blade mounting and control means for mounting said tucker blade to one of said first and second cylinders for compound pivotal motion; said compound pivotal motion comprising a motion which causes substantial alignment of said tucker blade axis with a given radius of the other of said first and second cylinders through a predetermined portion of cylinder rotation so as to urge said article into a folded condition while substantially preventing wiping engagement between said tucker blade and said article.

13. A folding apparatus according to claim 12 wherein said mounting and control means comprises means defining a stationary cam surface adjacent to an axial end of said one cylinder; a tucker blade control shaft rotatably mounted with respect to said one cylinder and operatively coupled with said tucker blade; cam follower means mounted to follow said cam surface and operatively coupled for bidirectionally rotating said tucker blade control shaft in a predetermined fashion in response to movement along said cam surface; and gear means coupled intermediate said tucker blade control shaft and said tucker blade for causing said compound pivotal motion of said tucker blade in response to said bidirectional rotation of said tucker blade control shaft.

14. A folding apparatus according to claim 13 wherein said tucker blade control shaft is mounted at a fixed location about the circumference of said one cylinder and is parallel to the axis of said one cylinder; and wherein said gear means comprises swing bracket means non-rotatably coupled to said tucker blade control shaft for bidirectional swinging motion in response to said bidirectional rotation of said tucker blade control shaft; a stationary gear rack coupled with said one cylinder; a first gear shaft rotatably mounted to said swing bracket means and parallel with said tucker blade control shaft; a first gear non-rotatably coupled to said first gear shaft and engaged with said stationary gear rack for bidirectional rotation thereby in response to said bidirectional swinging of said swing bracket means; and rotative coupling means coupled intermediate said first gear shaft and said tucker blade for rotating said tucker blade in response to rotation of said first gear.

15. A folding apparatus according to claim 14 wherein said rotative coupling means comprises second gear means coupled to said first gear shaft; a second gear shaft rotatably mounted to said swing bracket means and parallel with said first shaft; a third gear non-rotatably mounted to said second gear shaft and engaged with said second gear for rotation thereby; whereby the direction of rotation of said second gear shaft is generally opposite the direction of rotation of said first gear shaft and of said tucker blade control shaft; and means for mounting said tucker blade protruding radially from said second gear shaft and for movement in unison with said second gear shaft; whereby said compound pivotal movement of said tucker blade is defined by both the swinging of said swing bracket means and rotation of said second gear shaft.

16. A folding apparatus according to claim 13 wherein said stationary cam surface is oriented relative to said one cylinder for reversing the direction of rotation of said tucker blade control shaft at the location where said tucker blade most closely approaches said other cylinder; thereby reversing the direction of swinging of said swing bracket and the direction or rotation of said second gear shaft.

* * * * *